US010381215B2

(12) United States Patent
Ikeda et al.

(10) Patent No.: US 10,381,215 B2
(45) Date of Patent: Aug. 13, 2019

(54) TARGET FOR ULTRAVIOLET LIGHT GENERATION, AND METHOD FOR MANUFACTURING SAME

(71) Applicant: HAMAMATSU PHOTONICS K.K., Hamamatsu-shi, Shizuoka (JP)

(72) Inventors: Kohei Ikeda, Hamamatsu (JP); Norio Ichikawa, Hamamatsu (JP); Hiroyuki Taketomi, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/580,335

(22) PCT Filed: Jun. 6, 2016

(86) PCT No.: PCT/JP2016/066790
§ 371 (c)(1),
(2) Date: Dec. 7, 2017

(87) PCT Pub. No.: WO2016/199729
PCT Pub. Date: Dec. 15, 2016

(65) Prior Publication Data

US 2018/0182608 A1 Jun. 28, 2018

(30) Foreign Application Priority Data

Jun. 11, 2015 (JP) ..... 2015-118186

(51) Int. Cl.
*H01J 63/02* (2006.01)
*H01J 9/22* (2006.01)
(Continued)

(52) U.S. Cl.
CPC ..... *H01J 63/02* (2013.01); *H01J 9/22* (2013.01); *H01J 9/233* (2013.01); *H01J 63/06* (2013.01)

(58) Field of Classification Search
CPC .. H01J 64/00; H01J 64/02; H01J 64/04; H01J 64/06; H01J 9/22; H01J 9/33
See application file for complete search history.

(56) References Cited

U.S. PATENT DOCUMENTS

2004/0040650 A1 3/2004 Venturino et al.
2004/0040654 A1* 3/2004 Masuda ..... C30B 29/16 156/308.6
(Continued)

FOREIGN PATENT DOCUMENTS

CN 1466557 A 1/2004
CN 101449398 A 6/2009
(Continued)

OTHER PUBLICATIONS

International Preliminary Report on Patentability dated Dec. 21, 2017 for PCT/JP2016/066790.

*Primary Examiner* — Eliza W Osenbaugh-Stewart
(74) *Attorney, Agent, or Firm* — Drinker Biddle & Reath LLP

(57) ABSTRACT

A target for ultraviolet light generation 20A includes a sapphire substrate 21 that transmits ultraviolet light UV, an interlayer 22 that is in contact with the sapphire substrate 21, includes oxygen atoms and aluminum atoms in a composition, and transmits ultraviolet light UV, and a luminous layer 23 that is provided on the interlayer 22, includes oxide crystals containing rare earth elements to which an activator agent is added, and receives electron beams EB so as to generate ultraviolet light UV.

8 Claims, 31 Drawing Sheets

(51) Int. Cl.
*H01J 63/06* (2006.01)
*H01J 9/233* (2006.01)

(56) References Cited

U.S. PATENT DOCUMENTS

| | | | | |
|---|---|---|---|---|
| 2014/0048721 | A1* | 2/2014 | Honda | H01J 29/20 250/458.1 |
| 2014/0224292 | A1* | 8/2014 | Kim | H01G 9/21 136/205 |
| 2018/0076410 | A1* | 3/2018 | Kagotani | G02B 5/02 |

FOREIGN PATENT DOCUMENTS

| | | | |
|---|---|---|---|
| CN | 103502392 | A | 1/2014 |
| JP | S61-156691 | A | 7/1986 |
| JP | 2012-199174 | A | 10/2012 |
| JP | 2013-222925 | A | 10/2013 |
| WO | WO-2005/115740 | A1 | 12/2005 |

* cited by examiner (a)

(b)

(a)

(b)

(a)

(b)

(a)

(b)

(a)

(b)

(a)

(b)

TARGET FOR ULTRAVIOLET LIGHT GENERATION, AND METHOD FOR MANUFACTURING SAME

TECHNICAL FIELD

The present invention relates to a target for ultraviolet light generation and a method for manufacturing the same.

BACKGROUND ART

Patent Literature 1 discloses a thin-film EL element. In this thin-film EL element, in order to increase the extraction efficiency of light from phosphor layers, a rough surface is provided as the surface of a glass substrate. Patent Literature 2 discloses a substrate for LED and a method for manufacturing the same. This substrate for LED has a light extraction film for extracting light that exits from luminous layers in LED at a high efficiency. The outermost layer of the light extraction film has a nano-order random fine uneven structure including amorphous alumina or aluminum hydroxide as a principal component. Patent Literature 3 discloses a thin film-holding substrate that is used for the manufacturing of surface emitting bodies. This thin film-holding substrate is provided with a composite thin film including fine particles and a binder which is formed on a transparent base material in order to improve the light extraction efficiency of surface-emitting bodies.

CITATION LIST

Patent Literature

[Patent Literature 1] Japanese Unexamined Patent Publication No. S61-156691

[Patent Literature 2] Japanese Unexamined Patent Publication No. 2013-222925

[Patent Literature 3] International Publication No. 2005/115740

SUMMARY OF INVENTION

Technical Problem

In the related art, as ultraviolet light sources, electronic tubes such as mercury-xenon lamps and deuterium lamps have been used. However, these ultraviolet light sources have a low luminous efficiency and a large size and have problems with safety and service lives. In addition, in a case in which mercury-xenon lamps are used, there is a concern of the influence of mercury on the environment. Meanwhile, as additional ultraviolet light sources, electron beam-excited ultraviolet light sources having a structure in which ultraviolet light is excited by irradiating targets with electron beams. Electron beam-excited ultraviolet light sources are expected as optical measurement fields in which high stability is used, light sources for sterilization or light sources for disinfection in which low power consumption properties are used, medical light sources using high wavelength selectivity, or light sources for biochemistry.

In addition, recently, light-emitting diodes capable of outputting light in an ultraviolet range of wavelengths of 360 nm or shorter have been developed. However, the intensity of light output from these light-emitting diodes is still low, and, in light-emitting diodes, it is difficult to increase the area of luminous surfaces, and thus there is a problem with a limited range of applications. In contrast, electron beam-excited ultraviolet light sources are capable of generating ultraviolet light having a sufficient intensity, and it is also possible to output ultraviolet light having a large area and a uniform intensity by increasing the diameter of electron beams radiated to targets.

However, even for electron beam-excited ultraviolet light sources, there is a demand for additional improvement in the output efficiency. Generally, targets of electron beam-excited ultraviolet light sources include a supporting substrate and a luminous layer formed on the supporting substrate. The luminous layer receives electron beams and generates ultraviolet light, and the ultraviolet light passes through the supporting substrate and exits outside. In these targets, in order to further improve the output efficiency, for example, it is considered to roughen the surface of the supporting substrate (either or both the surface on the luminous layer side and the surface on the side opposite to the luminous layer) through which ultraviolet light passes. In such a case, it is possible to reduce reflection on the surface of the supporting substrate and increase the light extraction efficiency.

However, depending on the kind of supporting substrates, there are cases in which stable roughening is difficult. For example, in a case in which a supporting substrate is made of sapphire, it is not easy to control the surface roughness uniform due to the extremely high hardness of sapphire. In addition, since sapphire is insoluble in acids and alkalis, it is also difficult to etch the surface. Therefore, in targets including a sapphire substrate as the supporting substrate, there is a problem in that it is difficult to stably increase the light extraction efficiency.

The present invention has been made in consideration of the above-described problem, and an object of the present invention is to provide a target for ultraviolet light generation capable of increasing the extraction efficiency of ultraviolet light and a method for manufacturing the same.

Solution to Problem

In order to achieve the above-described object, a target for ultraviolet light generation according to an aspect of the present invention includes a sapphire substrate that transmits ultraviolet light, an interlayer that is in contact with the sapphire substrate, includes oxygen atoms and aluminum atoms in a composition, and transmits ultraviolet light, and a luminous layer that is provided on the interlayer, includes oxide crystals containing rare earth elements to which an activator agent is added, and receives electron beams so as to generate ultraviolet light.

The substrate in the target for ultraviolet light generation is a sapphire substrate. Therefore, it is not easy to process the surface of the substrate to a rough surface. Therefore, in the target for ultraviolet light generation, the interlayer is provided between the sapphire substrate and the luminous layer. This interlayer includes oxygen atoms and aluminum atoms in the composition and thus has a high affinity to the sapphire substrate that, similarly, includes oxygen atoms and aluminum atoms in the composition, and reflection on the interface with the sapphire substrate is also suppressed. In addition, for example, it is also possible to impart a variety of arbitrary fine structures for reducing the reflection of ultraviolet light to the interlayer as in individual constitutions described below. Therefore, according to the target for ultraviolet light generation, it becomes possible to increase the extraction efficiency of ultraviolet light.

In the target for ultraviolet light generation, the interlayer may be formed of an aggregate of fine structures. In such a case, it is possible to effectively reduce the reflection of ultraviolet light in the interlayer.

In the target for ultraviolet light generation, the interlayer may be formed by thermally treating an aluminum hydroxide film formed on the sapphire substrate. Alternatively, the fine structure may be a powder-form or granular aluminum oxide. It is possible to easily form the aggregate of the fine structures from any kinds of aluminum oxide.

In the target for ultraviolet light generation, the oxide crystals may be polycrystals. According to the present inventors' finding, polycrystals as the crystals constituting the luminous layer have a tendency of having a higher luminous efficiency than single crystals. Therefore, when the oxide crystals are polycrystals, it is possible to obtain more intense ultraviolet light.

A method for manufacturing a target for ultraviolet light generation according to another aspect of the present invention is a method for manufacturing the target for ultraviolet light generation including a first step of foaming an aluminum hydroxide film on the sapphire substrate and a second step of forming the interlayer by thermally treating the aluminum hydroxide film. According to this manufacturing method, it is possible to easily form an aggregate of fine structures, and thus it is possible to effectively reduce the reflection of ultraviolet light in the interlayer.

The manufacturing method may further include, a third step of disposing a material of the luminous layer on the interlayer after the second step and a fourth step of forming the luminous layer by thermally treating the material of the luminous layer. Alternatively, the manufacturing method may further include, a step of disposing a material of the luminous layer on the aluminum hydroxide film after the first step and before the second step, and, in the second step, the material of the luminous layer may be thermally treated together with the aluminum hydroxide film, thereby forming the interlayer and the luminous layer. With any kinds of methods described above, it is possible to preferably thermally treat both the interlayer and the luminous layer.

A method for manufacturing a target for ultraviolet light generation according to still another aspect of the present invention is a method for manufacturing the target for ultraviolet light generation including a first step of applying powder-form or granular aluminum oxide onto the sapphire substrate and a second step of forming the interlayer by thermally treating the powder-form or granular aluminum oxide. According to this manufacturing method, it is possible to easily form an aggregate of fine structures, and thus it is possible to effectively reduce the reflection of ultraviolet light in the interlayer.

Advantageous Effects of Invention

According to the target for ultraviolet light generation and the method for manufacturing the same as the aspects of the present invention, it is possible to increase the extraction efficiency of ultraviolet light.

DESCRIPTION OF EMBODIMENTS

Hereinafter, embodiments of a target for ultraviolet light generation and a method for manufacturing the same as aspects of the present invention will be described in detail with reference to the accompanying drawings. Meanwhile, in the description of the drawings, the same element will be given the same reference sign and will not be repeatedly described.

Figure 1:
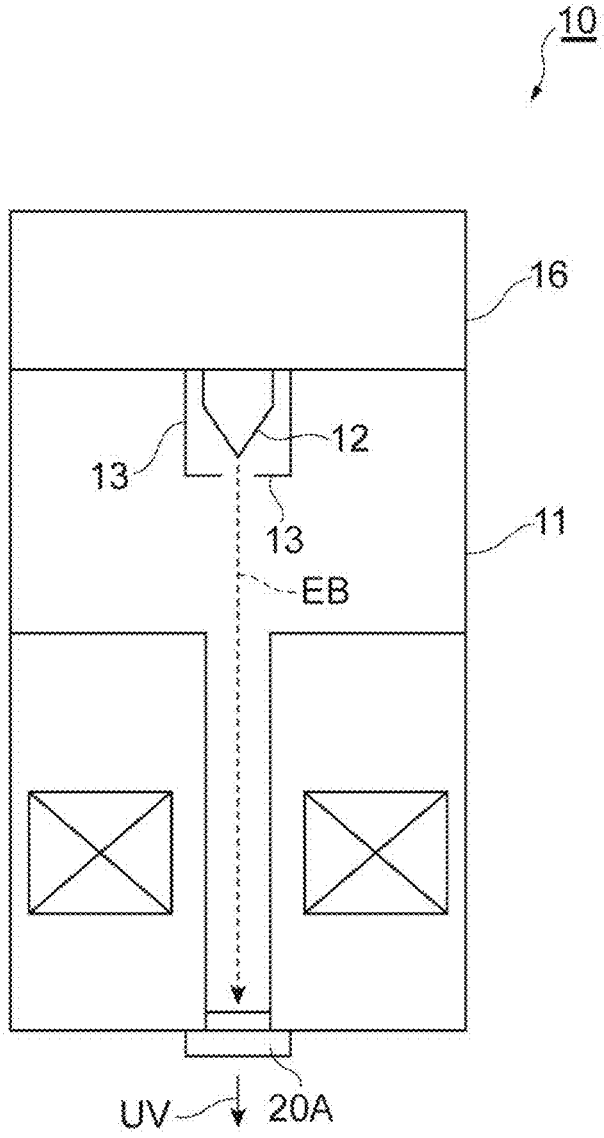
FIG. 1 is a schematic diagram illustrating an internal constitution of an electron beam-excited ultraviolet light source including a target for ultraviolet light generation according to a first embodiment.

(First Embodiment) FIG. 1 is a diagram illustrating the internal constitution of an electron beam-excited ultraviolet light source 10 including a target for ultraviolet light generation according to a first embodiment. As illustrated in FIG. 1, in this electron beam-excited ultraviolet light source 10, an electron source 12 and extraction electrodes 13 are disposed on the upper end side of the inside of a glass container (electronic tube) 11 evacuated to a vacuum. In addition, when an appropriate extraction voltage is applied to a space between the electron source 12 and the extraction electrodes 13 from a power supply portion 16, an electron beam EB accelerated by a high voltage exits from the electron source 12. As the electron source 12, for example, an electron source radiating large-area electron beams (for example, a cold cathode such as a carbon nanotube or a hot cathode) is used.

Figure 2:
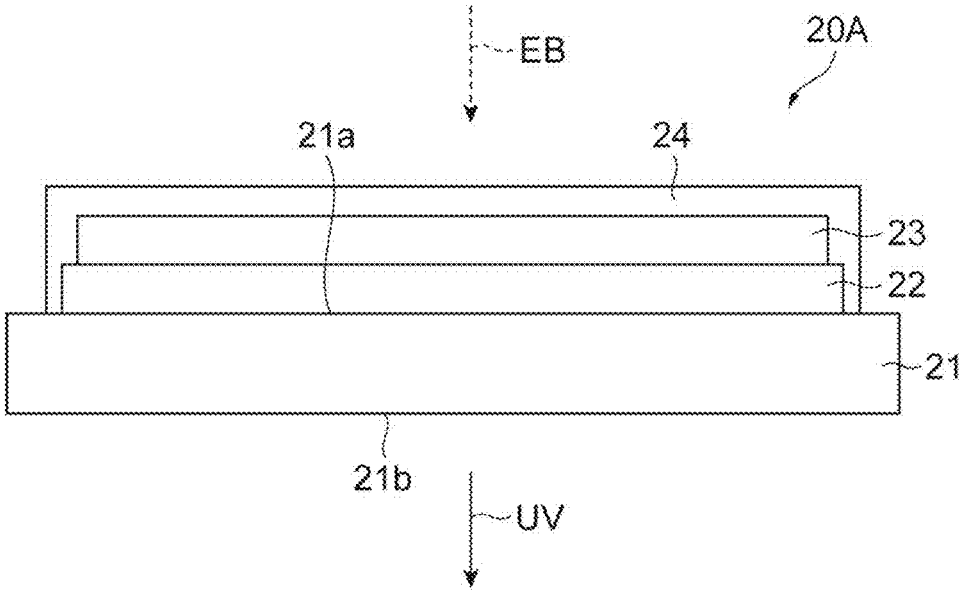
FIG. 2 is a side view illustrating a constitution of the target for ultraviolet light generation.

In addition, on the lower end side of the inside of the container 11, a target for ultraviolet light generation 20A is disposed. The target for ultraviolet light generation 20A is set to, for example, the ground potential, and, to the electron source 12, a negative high voltage is applied from the power supply portion 16. Therefore, the electron beam EB that has exited from the electron source 12 is radiated to the target for ultraviolet light generation 20A. The target for ultraviolet light generation 20A receives this electron beam EB, is excited, and generates ultraviolet light UV FIG. 2 is a side view illustrating the constitution of the target for ultraviolet light generation 20A. As illustrated in FIG. 2, the target for ultraviolet light generation 20A includes a substrate 21, an interlayer 22 provided on the substrate 21, a luminous layer 23 provided on the interlayer 22, and a light reflection film 24 provided on the luminous layer 23. The substrate 21 is a plate-like member made of a material that transmits the ultraviolet light UV and, in the present embodiment, made of sapphire ($Al_2O_3$). The substrate 21 has a main surface 21*a* and a rear surface 21*b*. The thickness of the substrate 21 is, for example, 0.1 mm or more and 10 mm or less.

The interlayer 22 is in contact with the main surface 21*a* of the substrate 21 and transmits the ultraviolet light UV The interlayer 22 is an aggregate of fine structures made of a material including oxygen atoms and aluminum atoms in the composition and, in the present embodiment, formed by thermally treating an aluminum hydroxide film ($Al_2O_3$.n ($H_2O$), n represents an integer of 1 or more) formed on the main surface 21*a*. Examples of the aluminum hydroxide film include boehmite (alumina monohydrate) films. The thermal treatment causes the aluminum hydroxide film to lose moisture, and thus, in the completed product of the target for ultraviolet light generation 20A, the interlayer 22 mainly includes aluminum oxide ($Al_2O_3$).

The luminous layer 23 receives the electron beam EB, is excited, and generates ultraviolet light UV. The luminous layer 23 includes oxide crystals containing rare earth elements to which an activator agent is added. The oxide crystals are polycrystals. The above-described oxide crystals are preferably rare earth element-containing aluminum garnet crystals to which an activator agent is added, and examples thereof include $Lu_3Al_5O_{12}$ to which Pr is added as the activator agent (Pr:LuAG). Alternatively, the above-described oxide crystals are preferably oxide crystals including Lu and Si, and examples thereof include $Lu_2Si_2O_7$ (LPS) and $Lu_2SiO_5$ (LSO). In addition, the luminous layer 23 may also include additional oxide crystals containing rare earth elements to which an activator agent is added other than the above-described oxide crystals, for example, $YAlO_3$ (Pr: YAP) to which Pr is added as the activator agent. Meanwhile, the luminous layer 23 may be made of one kind of material or a mixture of different kinds of crystals (for example, LPS and LSO).

The light reflection film 24 includes, for example, a metallic material such as aluminum. The light reflection film 24 covers the upper surface and the side surfaces of the luminous layer 23 and the side surfaces of the interlayer 22. Among ultraviolet light UV generated in the luminous layer 23, light travelling in a direction opposite to the substrate 21 is reflected by the light reflection film 24 and travels toward the substrate 21. Meanwhile, the light reflection film 24 also functions as an electrode. That is, when the light reflection film 24 is connected to the ground potential, it is possible to prevent electrons from remaining in the luminous layer 23 formed of an insulating material. Therefore, it is possible to cause the luminous layer 23 to stably emit light. Therefore, the light reflection film 24 is preferably formed to a thickness at which the excitation of the luminous layer 23 by the electron beam EB is not inhibited and the charging of the luminous layer 23 can be prevented (for example, approximately 50 nm).

In the target for ultraviolet light generation 20A, when the electron beam EB that has exited from the electron source 12 (refer to FIG. 1) enters the luminous layer 23, the luminous layer 23 is excited and generates ultraviolet light UV. A part of the ultraviolet light UV travels directly toward the main surface 21*a* of the substrate 21, and the remaining part of the ultraviolet light UV is reflected by the light reflection film 24 and then travels toward the main surface 21*a* of the substrate 21. After that, the ultraviolet light UV passes through the interlayer 22, enters the main surface 21*a*, passes through the substrate 21, and then is radiated to the outside through the rear surface 21*b*.

Figure 3:
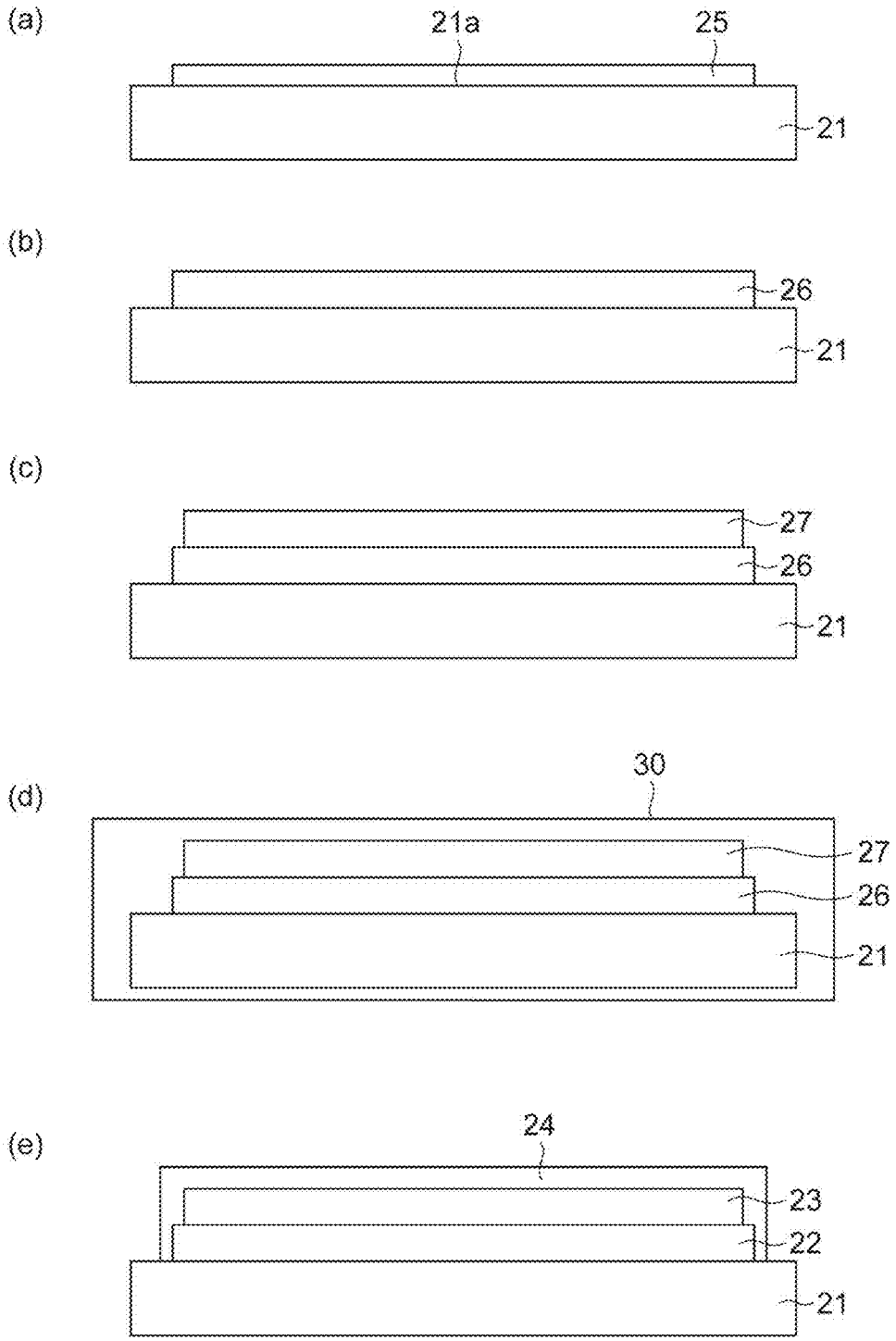
FIGS. 3(*a*), 3(*b*), 3(*c*), 3(*d*), and 3(*e*) are views illustrating individual steps in a method for manufacturing the target for ultraviolet light generation.

FIG. 3 illustrates views of individual steps in a method for manufacturing the target for ultraviolet light generation 20A. First, the aluminum hydroxide film is formed on the substrate 21 (a first step). In order for that, first, as illustrated in FIG. 3(*a*), an aluminum film 25 is formed on the main surface 21*a* of the substrate 21. As an example, before the formation of the film, the substrate 21 is washed with pure water and then heated in a vacuum. In addition, the aluminum film 25 is formed by means of, for example, vacuum deposition or sputtering. The thickness of the aluminum film 25 is, for example, 1 nm or more and 1,000 nm or less, and, as an example, may be any one of 50 nm, 100 nm, and 200 nm.

Next, a hot water treatment is carried out on the aluminum film 25. As an example, the substrate 21 is injected into a container storing boiled water, and the aluminum film 25 is boiled. The duration at this time is appropriately set depending on the thickness of the aluminum film 25. In a case in which the thickness of the aluminum film 25 is 50 nm, the boiling during is, for example, 10 minutes. In a case in which the thickness of the aluminum film 25 is 100 nm, the boiling during is, for example, 20 minutes. In a case in which the thickness of the aluminum film 25 is 200 nm, the boiling during is, for example, 1 hour and 15 minutes. After that, the substrate 21 is removed from the container, moisture attached to the substrate 21 is blown away, and then the substrate is dried. In the above-described manner, the aluminum film 25 on the substrate 21 turns into an aluminum hydroxide film (for example, boehmite film) 26 as illustrated in FIG. 3(*b*).

Subsequently, the material of the luminous layer 23 is disposed on the aluminum hydroxide film 26. Specifically, the substrate 21 on which the aluminum hydroxide film 26 is formed is installed in an ablation apparatus, and, as illustrated in FIG. 3(*c*), a luminous material layer 27 is formed on the aluminum hydroxide film 26 by means of laser ablation. The film thickness of the luminous material layer 27 is, for example, 500 nm.

Subsequently, a thermal treatment is carried out on the aluminum hydroxide film 26 and the luminous material layer 27 (a second step). In this step, as illustrated in FIG. 3(*d*), the substrate 21 on which the aluminum hydroxide film 26 and the luminous material layer 27 are formed is installed in a thermal treatment furnace 30. The thermal treatment furnace 30 is, for example, a vacuum furnace. In addition, the luminous material layer 27 and the aluminum hydroxide film 26 are thermally treated in a vacuum and fired. The thermal treatment temperature is, for example, 1,000° C. or higher and 2,000° C. or lower and, as an example, 1,500° C. In addition, the thermal treatment duration is, for example, zero hours (that is, the temperature is lowered immediately after reaching a predetermined temperature) or longer and 100 hours or shorter and, as an example, two hours. In such a case, the constituent material of the luminous material layer 27 crystallizes, and the luminous layer 23 illustrated in FIG. 1 is formed. In addition, moisture is removed from the aluminum hydroxide film 26, and the interlayer 22 mainly including aluminum oxide ($Al_2O_3$) is formed.

Finally, the substrate 21 on which the luminous layer 23 and the interlayer 22 are formed is removed from the thermal treatment furnace 30, and, as illustrated in FIG. 3(*e*), the light reflection film 24 is formed so as to cover the upper surface and the side surfaces of the luminous layer 23 and the side surfaces of the interlayer 22. The method for forming the light reflection film 24 is, for example, vacuum deposition. The thickness of the light reflection film 24 on the upper surface of the luminous layer 23 is, for example, 50 nm. Through the above-described steps, the target for ultraviolet light generation 20A of the present embodiment is completed.

Figure 4:
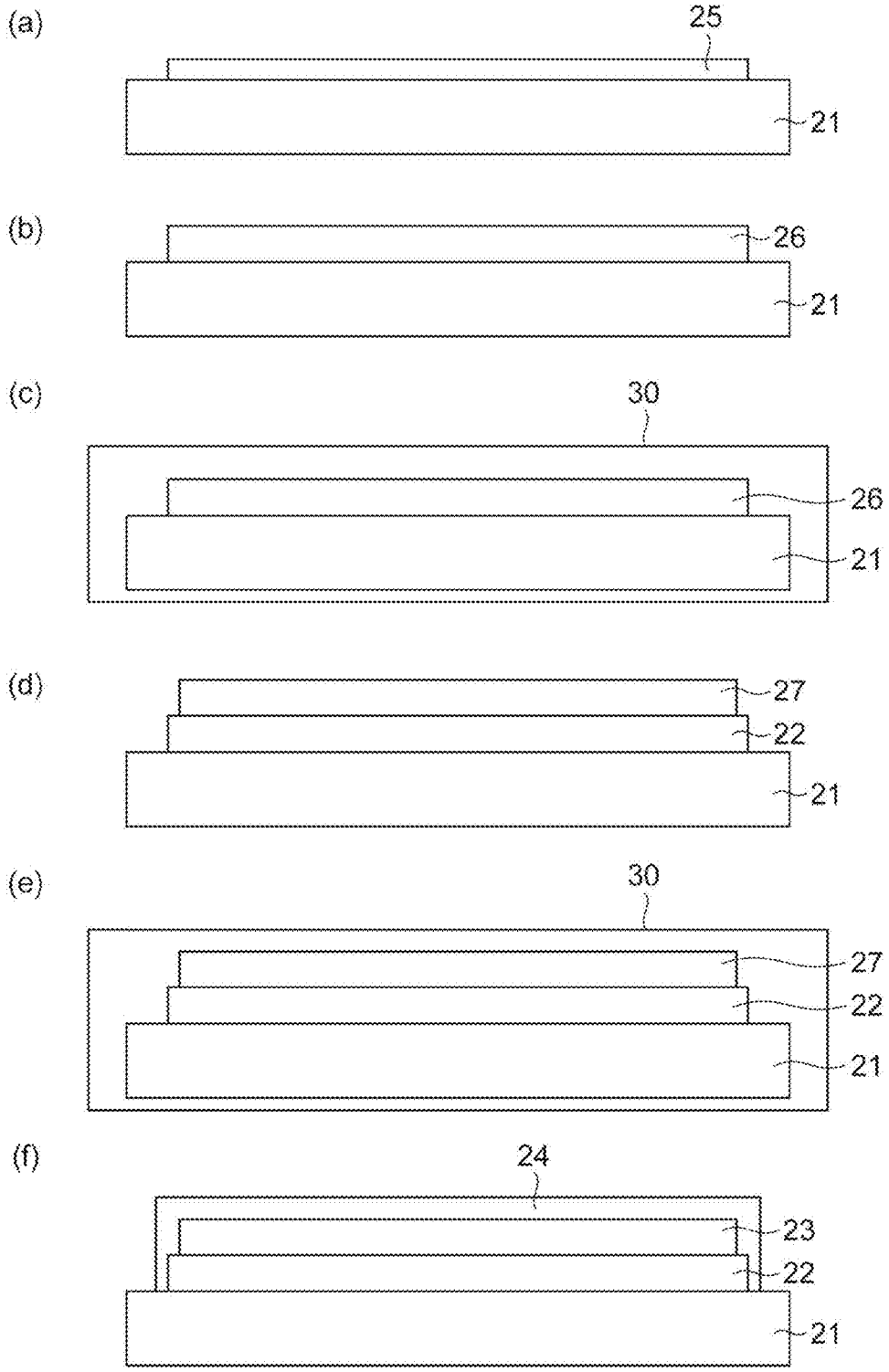
FIGS. 4(*a*), 4(*b*), 4(*c*), 4(*d*), 4(*e*), and 4(*f*) are views illustrating individual steps in a manufacturing method different from the manufacturing method illustrated in FIG. 3.

FIG. 4 illustrates views of individual steps in a manufacturing method different from the manufacturing method illustrated in FIG. 3.

In this manufacturing method, the aluminum film 25 is formed on the substrate 21 as illustrated in FIG. 4(*a*), and then the same hot water treatment as described above is carried out on the aluminum film 25, thereby forming the aluminum hydroxide film (for example, boehmite film) 26 as illustrated in FIG. 4(*b*) (a first step). Subsequently, a thermal treatment is carried out on the aluminum hydroxide film, thereby forming the interlayer (a second step). In this step, the substrate 21 on which the aluminum hydroxide film 26 is formed is installed in the thermal treatment furnace 30 as illustrated in FIG. 4(*c*). In addition, the aluminum hydroxide film 26 is thermally treated in a vacuum and fired. Therefore, moisture is removed from the aluminum hydroxide film 26, and the interlayer 22 mainly including aluminum oxide ($Al_2O_3$) is formed.

Subsequently, the material of the luminous layer 23 is disposed on the interlayer 22 (a third step). In this step, the substrate 21 on which the interlayer 22 is foamed is installed in an ablation apparatus, and, as illustrated in FIG. 4(*d*), the luminous material layer 27 is formed on the interlayer 22 by means of laser ablation. In addition, as illustrated in FIG. 4(*e*), the substrate 21 on which the luminous material layer 27 is fanned is installed in the thermal treatment furnace 30, and the luminous material layer 27 is thermally treated in a vacuum and fired. The thermal treatment temperature and the thermal temperature duration are the same as those in the above-described manufacturing method. Therefore, the constituent material of the luminous material layer 27 crystallizes, and the luminous layer 23 is formed (a fourth step). Finally, the substrate 21 on which the luminous layer 23 and the interlayer 22 are formed is removed from the thermal treatment furnace 30, and, as illustrated in FIG. 4(*f*), the light reflection film 24 is formed. Through the above-described steps, the target for ultraviolet light generation 20A of the present embodiment is completed.

Figure 5:
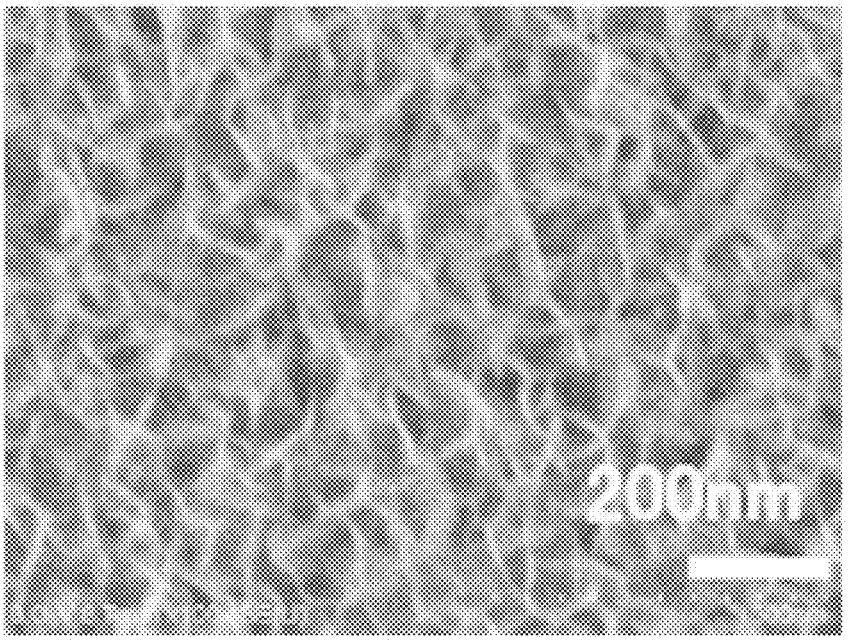
FIG. 5 is an enlarged SEM image of an interlayer.

FIG. 5 is an enlarged SEM image of the interlayer 22 obtained using any one of the above-described manufacturing methods. As illustrated in FIG. 5, the interlayer 22 is made of an aggregate of fine structures. The fine structure is aluminum oxide ($Al_2O_3$) from which moisture has been removed. The size of one fine structure is, for example, 50 nm in thickness and 200 nm in length.

Effects obtained by the target for ultraviolet light generation 20A of the present embodiment described above will be described. In the target for ultraviolet light generation 20A, the substrate 21 which is a supporting substrate is a sapphire substrate. As described above, it is not easy to process the surface of the sapphire substrate to a rough surface. Therefore, in the present embodiment, the interlayer 22 is provided between the substrate 21 and the luminous layer 23. This interlayer 22 includes oxygen atoms and aluminum atoms in the composition and thus has a high affinity to the substrate 21 which, similarly, includes oxygen atoms and aluminum atoms in the composition, and the reflection of ultraviolet light UV in the interface with the substrate 21 is also suppressed. In addition, for example, as illustrated in FIG. 5, it is possible to impart fine structures for reducing the reflection of ultraviolet light UV to the interlayer 22. Therefore, according to the present embodiment, it becomes possible to increase the extraction efficiency of ultraviolet light UV.

In addition, as in the present embodiment, the interlayer 22 may be formed of an aggregate of fine structures. In such a case, it is possible to effectively reduce the reflection of ultraviolet light UV in the interlayer 22. In addition, in this case, the interlayer 22 may be formed by thermally treating the aluminum hydroxide film 26 formed on the substrate 21. In such a case, it is possible to easily form an aggregate of fine structures as illustrated in FIG. 5.

In addition, as in the present embodiment, crystals constituting the luminous layer 23 (oxide crystals containing rare earth elements to which the activator agent is added) may be polycrystals. According to the present inventors' finding, polycrystals as the crystals constituting the luminous layer 23 have a tendency of having a higher luminous efficiency than single crystals. Therefore, when the crystals constituting the luminous layer 23 are polycrystals, it is possible to obtain more intense ultraviolet light UV.

In addition, the manufacturing method of the present embodiment includes the first step of forming the aluminum hydroxide film 26 on the substrate 21 and the second step of forming the interlayer 22 by thermally treating the aluminum hydroxide film 26. According to the manufacturing method, it is possible to easily faun the aggregate of fine structures, and thus it is possible to effectively reduce the reflection of ultraviolet light UV in the interlayer 22.

In addition, as illustrated in FIG. 3, the interlayer 22 and the luminous layer 23 may be formed by disposing the luminous material layer 27 on the aluminum hydroxide film 26 after the first step and before the second step and, in the second step, thermally treating the luminous material layer 27 together with the aluminum hydroxide film 26. Alternatively, as illustrated in FIG. 4, the manufacturing method may further includes, after the second step, the third step of disposing the luminous material layer 27 on the interlayer 22 and the fourth step of forming the luminous layer 23 by thermally treating the luminous material layer 27. With any method of the methods described above, it is possible to preferably thermally treat both the interlayer 22 and the luminous layer 23.

FIRST EXAMPLE

Subsequently, the target for ultraviolet light generation 20A of the first embodiment is produced, and the investigation results of the light output characteristics thereof will be described. In the present example, a target for ultraviolet light generation not provided with the interlayer 22 and three targets for ultraviolet light generation 20A provided with the interlayer 22 were produced. The thickness of the aluminum film 25 used to form the interlayers 22 in the three targets for ultraviolet light generation 20A were 50 nm, 100 nm, and 200 nm respectively. At this time, using the manufacturing method illustrated in FIG. 3, a boehmite film was provided as the aluminum hydroxide film 26, a Pr:LuAG polycrystal film was provided as the luminous layer 23, a sapphire substrate (diameter: 12 mm and thickness: 2 mm) was provided as the substrate 21, the thermal treatment temperature was set to 1,500° C., and the thermal treatment duration was set to two hours. In addition, the acceleration voltage of an electron beam-excited ultraviolet light source to which the targets for ultraviolet light generation were attached was set to 10 kV, the tube current was set to 200 μA, and the electron beam diameter was set to 2 mm.

Figure 6:
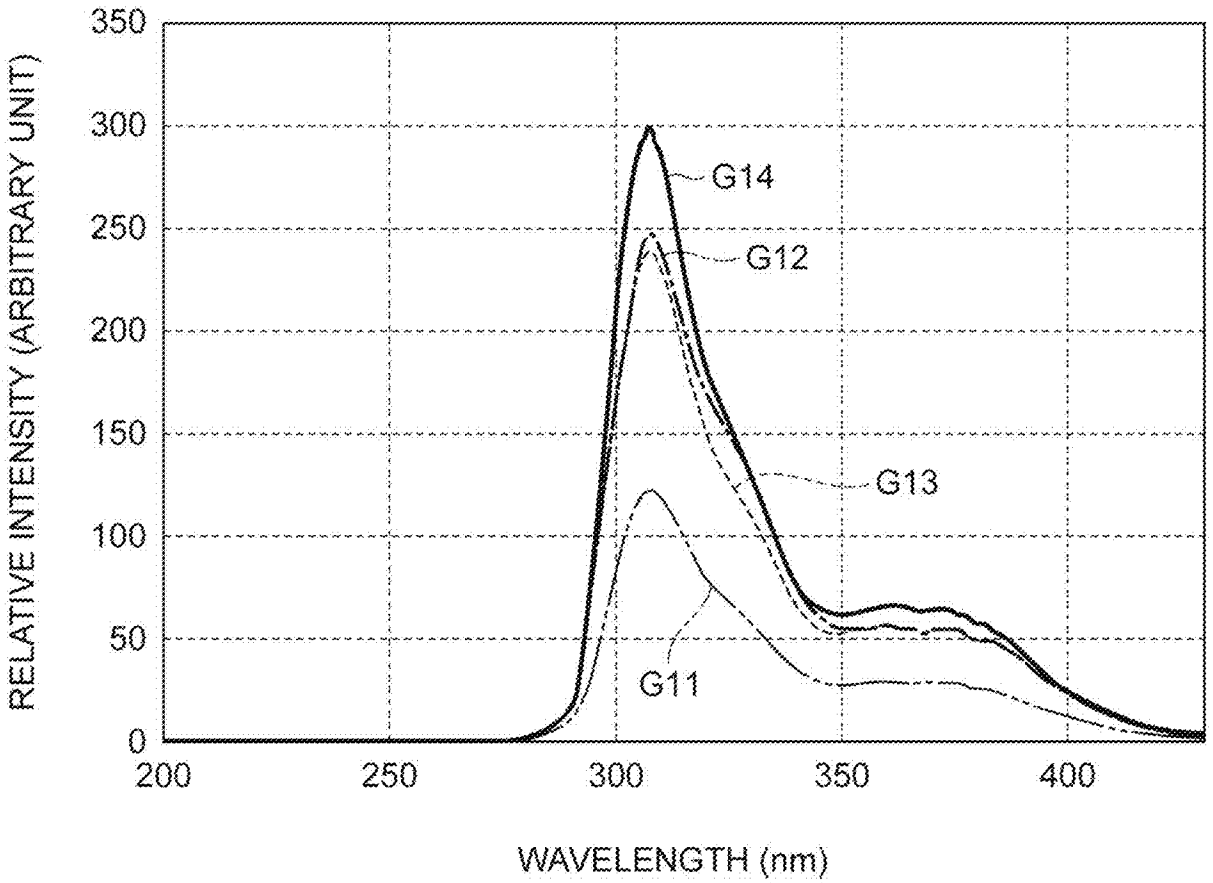
FIG. 6 is a graph illustrating luminous intensities (relative values) at individual wavelengths in a first example.

FIG. 6 is a graph illustrating luminous intensities (relative values) at individual wavelengths. In FIG. 6, a graph G11 illustrates a case in which the interlayer 22 was not provided, and graphs G12, G13, and G14 illustrate cases in which the thickness of the aluminum film 25 was 50 nm, 100 nm, and 200 nm respectively. As illustrated in FIG. 6, in the cases in which the interlayer 22 was provided, higher peak intensities were obtained than the case in which the interlayer 22 was not provided, and furthermore, there was a tendency that the peak intensity increases as the aluminum film 25 becomes thicker (that is, the interlayer 22 becomes thicker). For example, in the case in which the thickness of the aluminum film 25 was 200 nm (the graph G14), it was possible to realize a peak intensity that was approximately 2.4 times the peak intensity in the case in which the interlayer 22 was not provided (the graph G11).

Figure 7:
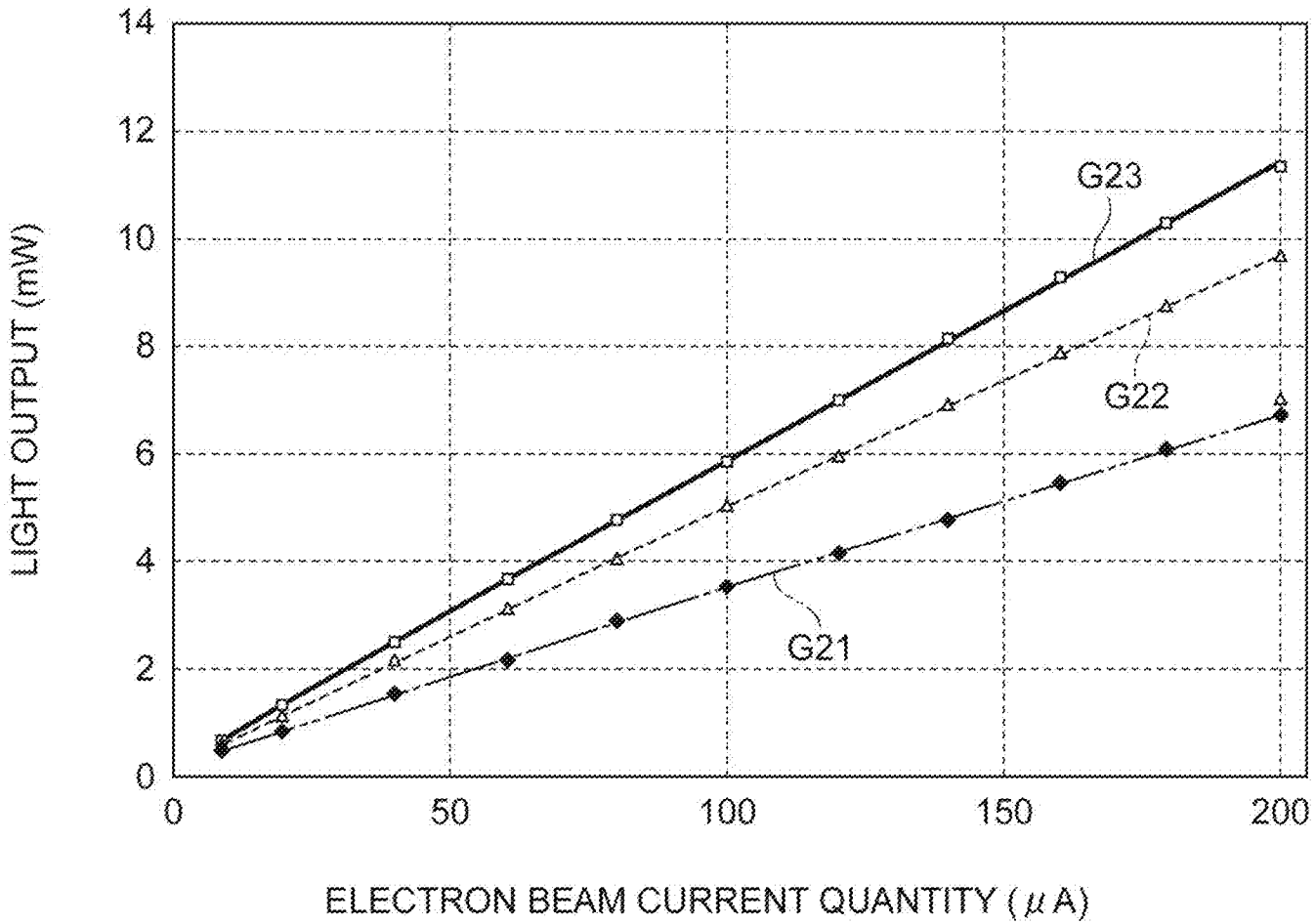
FIG. 7 is a graph illustrating a relationship between an electron beam current quantity and a light output in the first example.

FIG. 7 is a graph illustrating a relationship between the electron beam current quantity and the light output. In FIG. 7, a graph G21 illustrates the case in which the interlayer 22 was not provided, and graphs G22 and G23 illustrate the cases in which the thickness of the aluminum film 25 was 100 nm and 200 run respectively. As illustrated in FIG. 7, in the cases in which the interlayer 22 was provided, higher light output efficiencies were obtained than the case in which the interlayer 22 was not provided, and furthermore, there was a tendency that the light output efficiency increases as the interlayer 22 becomes thicker. For example, in the case in which the thickness of the aluminum film 25 was 200 nm (the graph G23), it was possible to realize a light output efficiency that was approximately 1.7 times the light output efficiency in the case in which the interlayer 22 was not provided (the graph G21).

Figure 8:
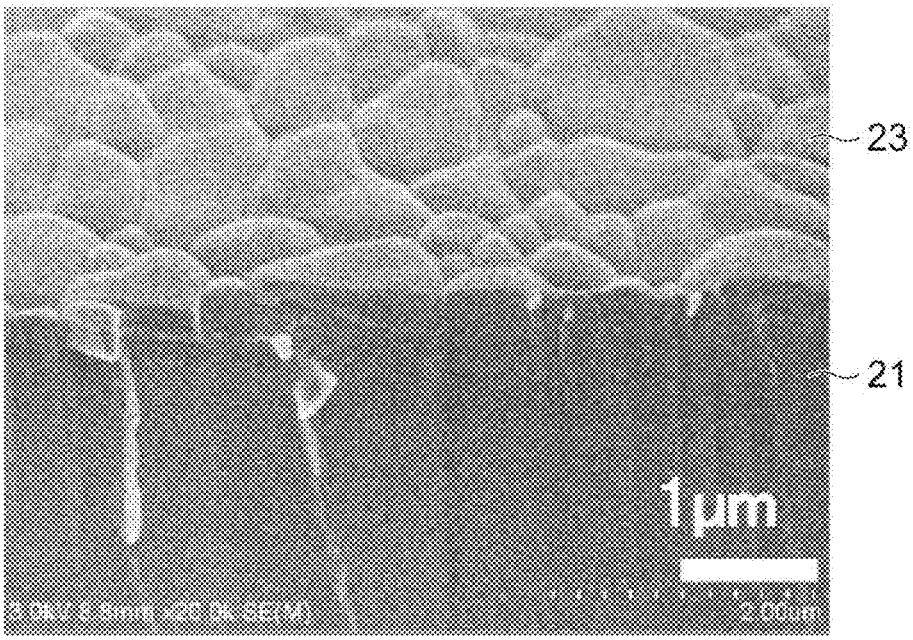
FIG. 8 is an enlarged SEM image illustrating a cross section of a sapphire substrate and a luminous layer in a case in which the interlayer is not provided.
Figure 9:
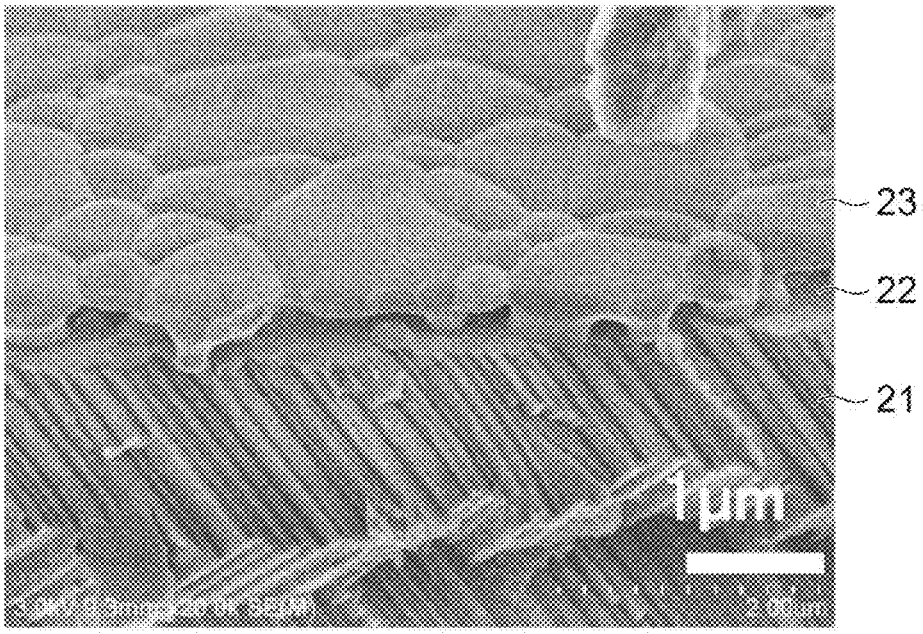
FIG. 9 is an enlarged SEM image illustrating a cross section of the sapphire substrate, the interlayer, and the luminous layer in a case in which the interlayer is provided.

FIG. 8 is an enlarged SEM image illustrating a cross section of the sapphire substrate 21 and the luminous layer 23 in the case in which the interlayer 22 was not provided. In addition, FIG. 9 is an enlarged SEM image illustrating a cross section of the sapphire substrate 21, the interlayer 22, and the luminous layer 23 in the case in which the interlayer 22 was provided. When FIG. 8 and FIG. 9 are compared to each other, it is found that the interlayer 22 including fine structures is preferably formed between the sapphire substrate 21 and the luminous layer 23.

FIRST COMPARATIVE EXAMPLE

Figure 10:
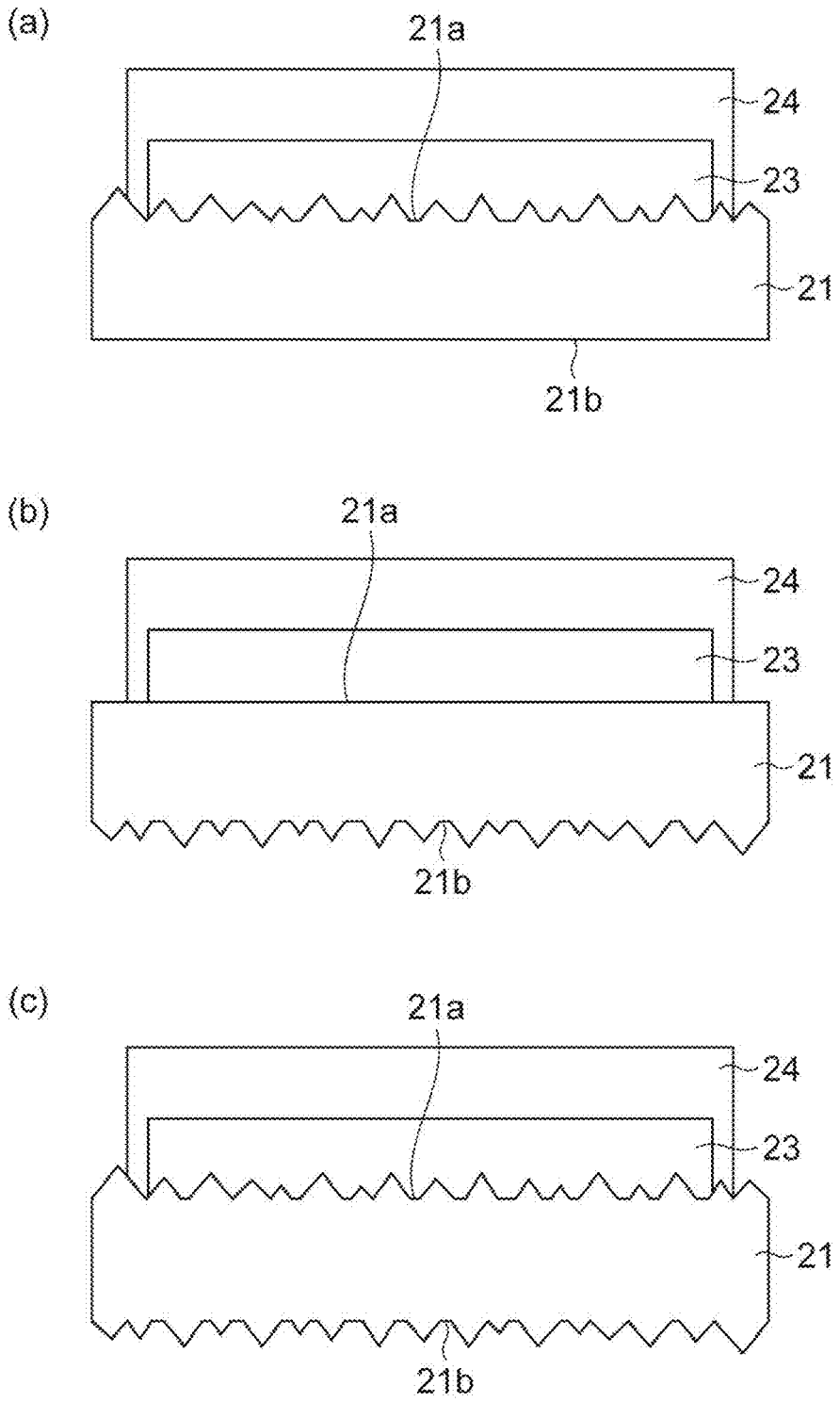
FIGS. 10(*a*), 10(*b*), and 10(*c*) are views illustrating constitutions of a target for ultraviolet light generation according to a first comparative example.

Here, for comparison, the light output characteristics were investigated when the surface of the substrate 21 was roughened in the target for ultraviolet light generation not provided with the interlayer 22. In the present comparative example, as illustrated in FIG. 10, luminous intensities (relative values) at individual wavelengths were investigated respectively for a case in which only the main surface 21*a* of the substrate 21 was roughened (FIG. 10(*a*)), a case in which only the rear surface 21*b* of the substrate 21 was roughened (FIG. 10(*b*)), and a case in which both the main surface 21*a* and the rear surface 21*b* were roughened (FIG. 10(*c*)).

Figure 11:
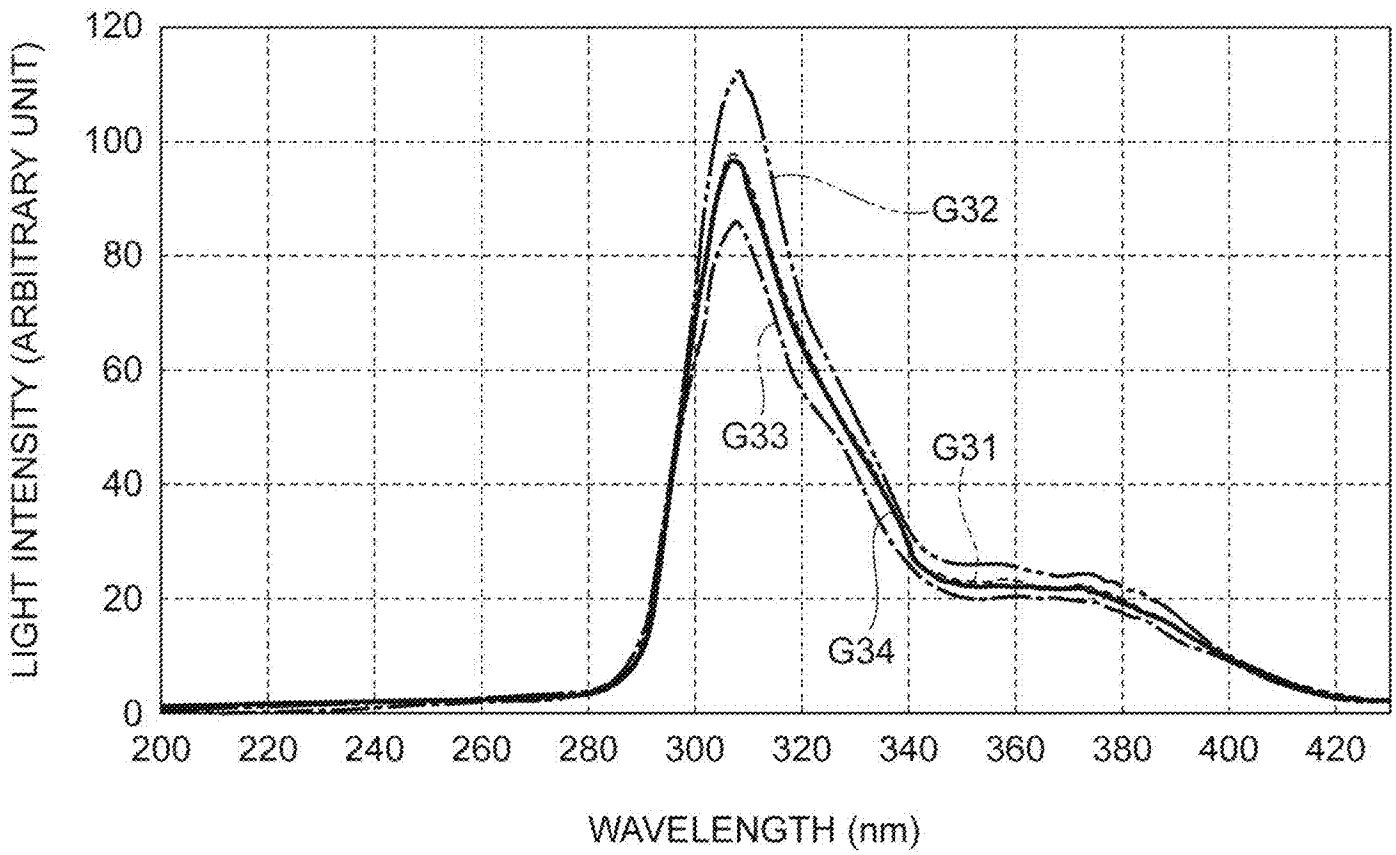
FIG. 11 is a graph illustrating luminous intensities (relative values) at individual wavelengths in the first comparative example.

The results are illustrated in FIG. 11. In FIG. 11, a graph G31 illustrates a case in which both the main surface 21*a* and the rear surface 21*b* were not roughened, a graph G32 illustrates the case in which only the main surface 21*a* was roughened, a graph G33 illustrates the case in which only the rear surface 21*b* was roughened, and a graph G34 illustrates the case in which both the main surface 21*a* and the rear surface 21*b* were roughened. As illustrated in FIG. 11, the peak intensity was maximized in the case in which only the main surface 21*a* was roughened. However, even in that case, the peak intensity increased to approximately 1.2 times the peak intensity of the case in which both the main surface 21*a* and the rear surface 21*b* were not roughened. According to the target for ultraviolet light generation 20A of the first embodiment, an extremely higher peak intensity can be obtained compared to the cases in which the surface(s) of the substrate is roughened as described above.

SECOND COMPARATIVE EXAMPLE

Furthermore, for comparison, in the form in which only the main surface 21*a* of the substrate 21 was roughened, the main surface 21*a* was roughened at a variety of surface roughness by means of sand blasting, and light output characteristics were investigated. In the present comparative example, a target for ultraviolet light generation including an ordinary substrate having surfaces that were not roughened, and seven targets for ultraviolet light generation in which the surface roughness of the main surface 21*a* were 0.1 μm, 0.3 μm, 1.0 μm, 2.0 μm, 3.0 μm, 5.0 μm, and 10 μm respectively were produced. In these targets for ultraviolet light generation, Pr:LuAG crystals were formed on a sapphire substrate for one hour by means of laser ablation and thermally treated at 1,500° C. for two hours in a vacuum, and a 50 nm-thick light reflection film was deposited thereon. Meanwhile, the acceleration voltage of an electron beam-excited ultraviolet light source to which the targets for ultraviolet light generation were attached was set to 10 kV, the tube current was set to 200 μA, and the electron beam diameter was set to 2 mm.

Figure 12:
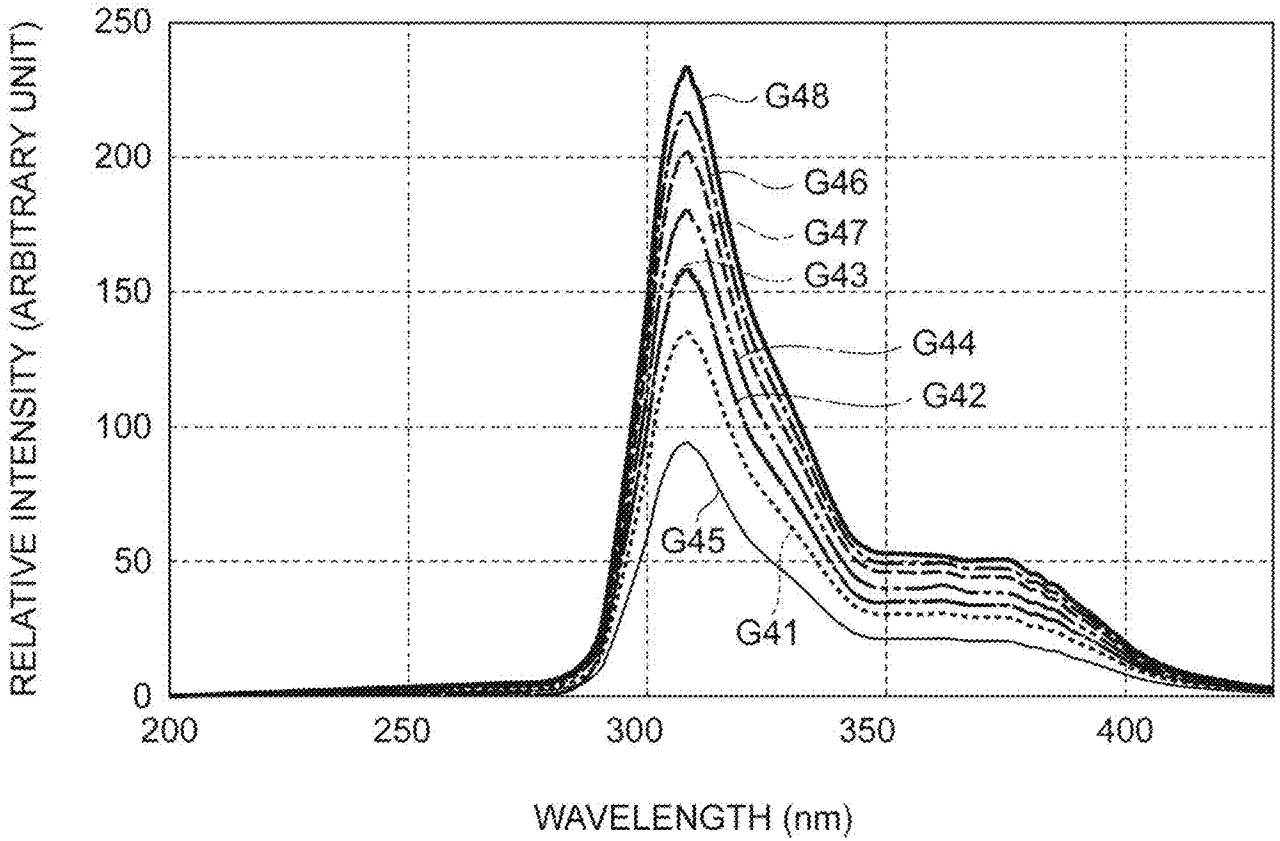
FIG. 12 is a graph illustrating luminous intensities (relative values) at individual wavelengths in a second comparative example.

FIG. 12 is a graph illustrating luminous intensities (relative values) at individual wavelengths. In FIG. 12, a graph G41 illustrates a case in which surface roughening was not carried out, and graphs G42 to G48 illustrate cases in which the surface roughness of the main surfaces 21*a* was 0.1 μm, 0.3 μm, 1.0 μm, 2.0 μm, 3.0 μm, 5.0 μm, and 10 μm respectively. As illustrated in FIG. 12, in the cases in which the main surface 21*a* was roughened, higher peak intensities were obtained than the case in which the main surface was not roughened, and generally, there was a tendency that the peak intensity increases as the surface roughness increases. For example, in the case of a surface roughness of 10 μm at which the peak intensity was the highest (the graph G48), it was possible to realize a peak intensity that was approximately 1.6 times the peak intensity in the case in which surface roughening was not carried out (the graph G41). However, according to the target for ultraviolet light generation 20A of the first embodiment, a higher peak intensity can be obtained compared to the cases of the surface roughness of 10 μm.

Figure 13:
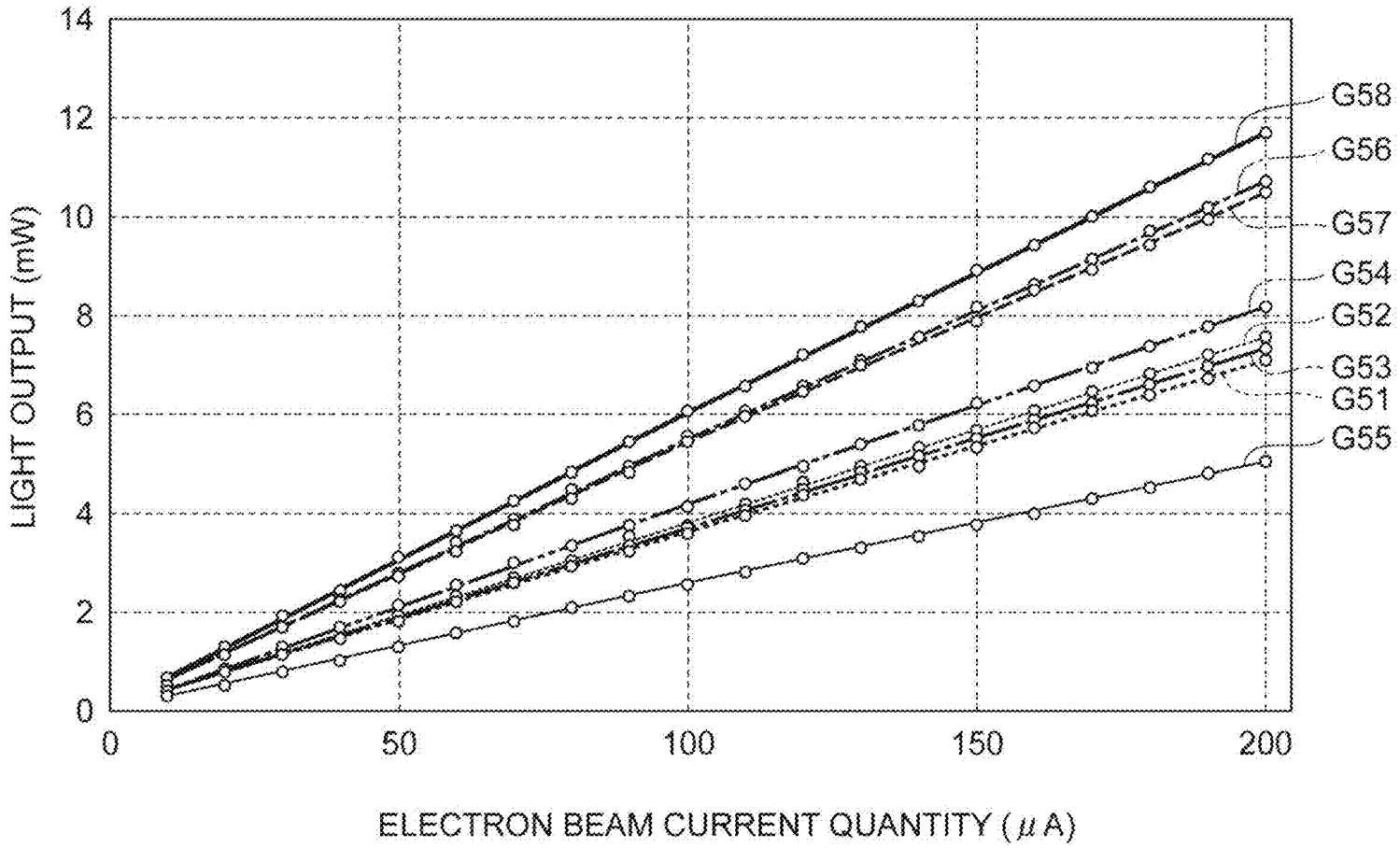
FIG. 13 is a graph illustrating a relationship between an electron beam current quantity and a light output in the second comparative example.

In addition, FIG. 13 is a graph illustrating a relationship between the electron beam current quantity and the light output. In FIG. 13, a graph G51 illustrates a case in which surface roughening was not carried out, and graphs G52 to G58 illustrate cases in which the surface roughness of the main surfaces 21*a* was 0.1 μm, 0.3 μm, 1.0 μm, 2.0 μm, 3.0 μm, 5.0 μm, and 10 μm respectively. As illustrated in FIG. 13, in the cases in which the main surface 21*a* was roughened, a higher light output efficiency was obtained than the case in which the main surface was not roughened, and generally, there was a tendency that the light output efficiency increases as the surface roughness increases. For example, in the case of a surface roughness of 10 μm at which the light output intensity was the highest (the graph G58), it was possible to realize a light output intensity that was approximately 1.6 times the light output intensity in the case in which surface roughening was not carried out (the graph G51). However, according to the target for ultraviolet light generation 20A of the first embodiment, a higher light output efficiency can be obtained compared to the cases of the surface roughness of 10 μm.

MODIFICATION EXAMPLE

Figure 14:
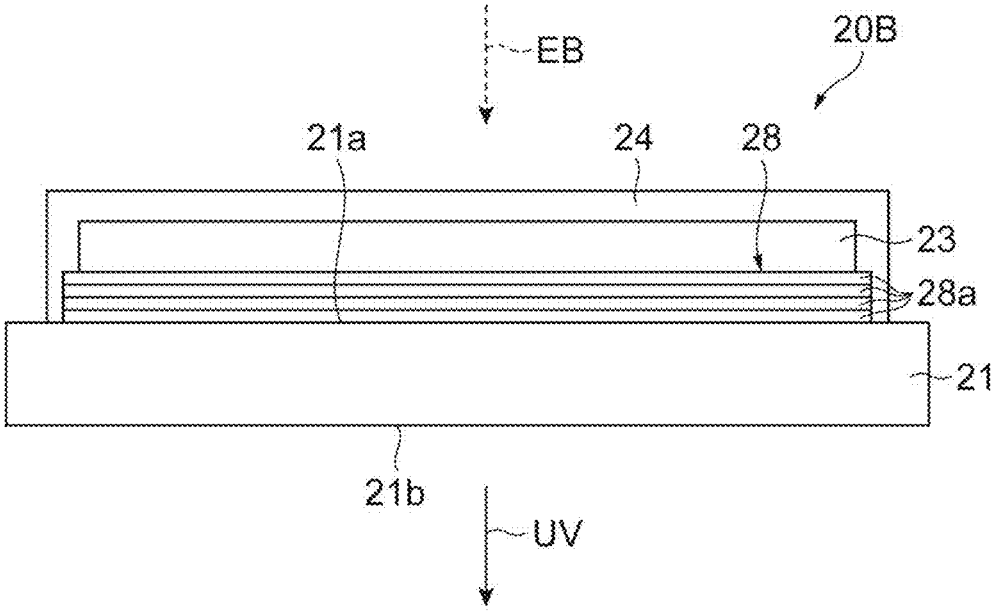
FIG. 14 is a side view illustrating a constitution of a target for ultraviolet light generation according to a modification example.

A modification example of the embodiment will be described. FIG. 14 is a side view illustrating the constitution of a target for ultraviolet light generation 20B according to the present modification example. As illustrated in FIG. 14, the target for ultraviolet light generation 20B includes the substrate 21, an interlayer 28 provided on the substrate 21, the luminous layer 23 provided on the interlayer 28, and the light reflection film 24 provided on the luminous layer 23. Among these, the substrate 21, the luminous layer 23, and the light reflection film 24 have the same constitution as described in the embodiment.

The interlayer 28 in the present modification example is formed by laminating a plurality of layers 28*a*. Each of the plurality of layers 28*a* has the same constitution as that of the interlayer 22 in the embodiment. Meanwhile, FIG. 14 exemplifies a case in which four layers 28*a* are laminated together, but the number of layers 28*a* laminated together is an arbitrary number of two or more.

Figure 15:
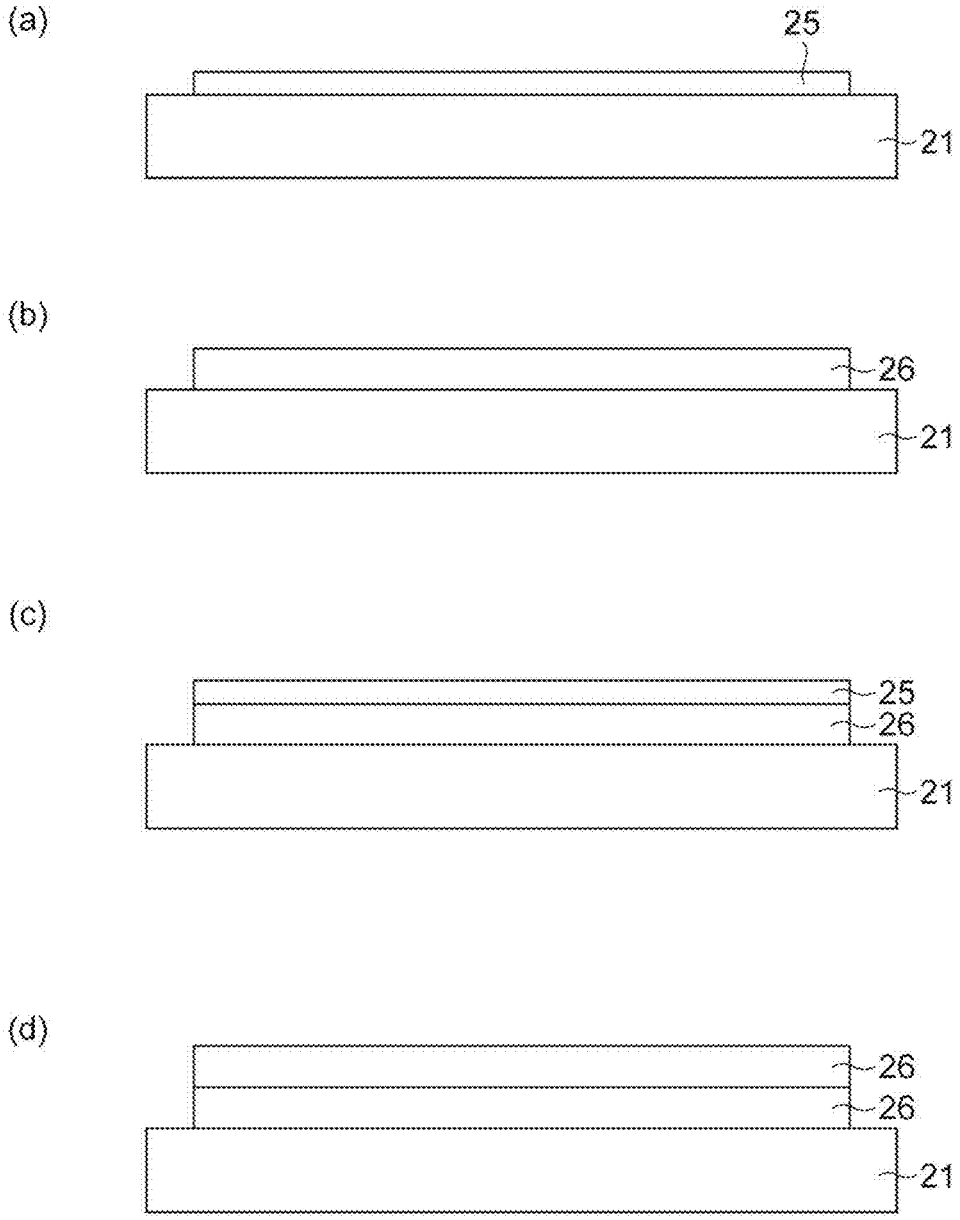
FIGS. 15(*a*), 15(*b*), 15(*c*), and 15(*d*) are views illustrating, in a method for manufacturing a target for ultraviolet light generation according to the modification example, individual steps for forming an interlayer.

FIG. 15 illustrates, in a method for manufacturing the target for ultraviolet light generation 20B according to the present modification example, individual steps for forming the interlayer 28. Meanwhile, other steps except for the step of forming the interlayer 28 are the same as in the embodiment.

First, in order to form an initial layer 28*a*, an aluminum hydroxide film is formed on the substrate 21. In order for that, as illustrated in FIG. 15(*a*), first, the aluminum film 25 is formed on the main surface 21*a* of the substrate 21. Next, a hot water treatment is carried out on the aluminum film 25. Therefore, the aluminum film 25 turns into the aluminum hydroxide film (for example, boehmite film) 26 as illustrated in FIG. 15(*b*).

Subsequently, in order to form the next layer 28*a*, another aluminum hydroxide film is formed on the aluminum hydroxide film 26. That is, as illustrated in FIG. 15(*c*), the aluminum film 25 is formed on the aluminum hydroxide film 26. Next, a hot water treatment is carried out on the aluminum film 25. Therefore, the aluminum film 25 turns into the aluminum hydroxide film 26 as illustrated in FIG. 15(*d*). Subsequently, the formation of the aluminum hydroxide film 26 is repeatedly carried out, whereby a plurality of aluminum hydroxide films 26 is obtained.

After that, a thermal treatment is carried out on the plurality of aluminum hydroxide films 26 laminated together using the same method as illustrated in FIG. 3 or FIG. 4. Therefore, moisture is removed from the plurality of aluminum hydroxide film 26, and a plurality of layers 28*a* mainly including aluminum oxide ($Al_2O_3$) is formed.

According to the target for ultraviolet light generation 20B of the present modification example described above, similar to the embodiment, the interlayer 28 includes oxygen atoms and aluminum atoms in the composition, and it is possible to impart a variety of arbitrary fine structures for reducing the reflection of ultraviolet light UV to the interlayer 28. Therefore, it becomes possible to increase the extraction efficiency of ultraviolet light W. Particularly, when the plurality of layers 28*a* is laminated together as in the present modification example, it is possible to further increase the extraction efficiency of ultraviolet light UV as described in examples described below. In addition, even in a case in which the interlayer 28 is formed thick, it is possible to reliably form the aluminum hydroxide film within a short period of time by a hot water treatment by thinning the respective layers 28*a*.

SECOND EXAMPLE

A target for ultraviolet light generation 20B of the second embodiment is produced, and the investigation results of the light output characteristics thereof will be described. In the present example, a target for ultraviolet light generation not provided with the interlayer 28 and three targets for ultraviolet light generation 20B in which the number of the layers 28*a* laminated together to form the interlayer 28 is two, three, and four respectively were produced. At this time, using the same manufacturing method as the manufacturing method illustrated in FIG. 3 (the interlayer 28 and the luminous layer 23 are thermally treated at the same time), the duration for forming the aluminum film 25 illustrated in FIG. 15 was set to four minutes, the thickness was set to 100 nm, a boehmite film was provided as the aluminum hydroxide film 26, a Pr:LuAG polycrystal film was provided as the luminous layer 23, a sapphire substrate (diameter: 12 mm and thickness: 2 mm) was provided as the substrate 21, the thermal treatment temperature was set to 1,500° C., and the thermal treatment duration was set to two hours. In addition, the acceleration voltage of an electron beam-excited ultraviolet light source to which the targets for ultraviolet light generation were attached was set to 10 kV, the tube current was set to 200 μA, and the electron beam diameter was set to 2 mm.

Figure 16:
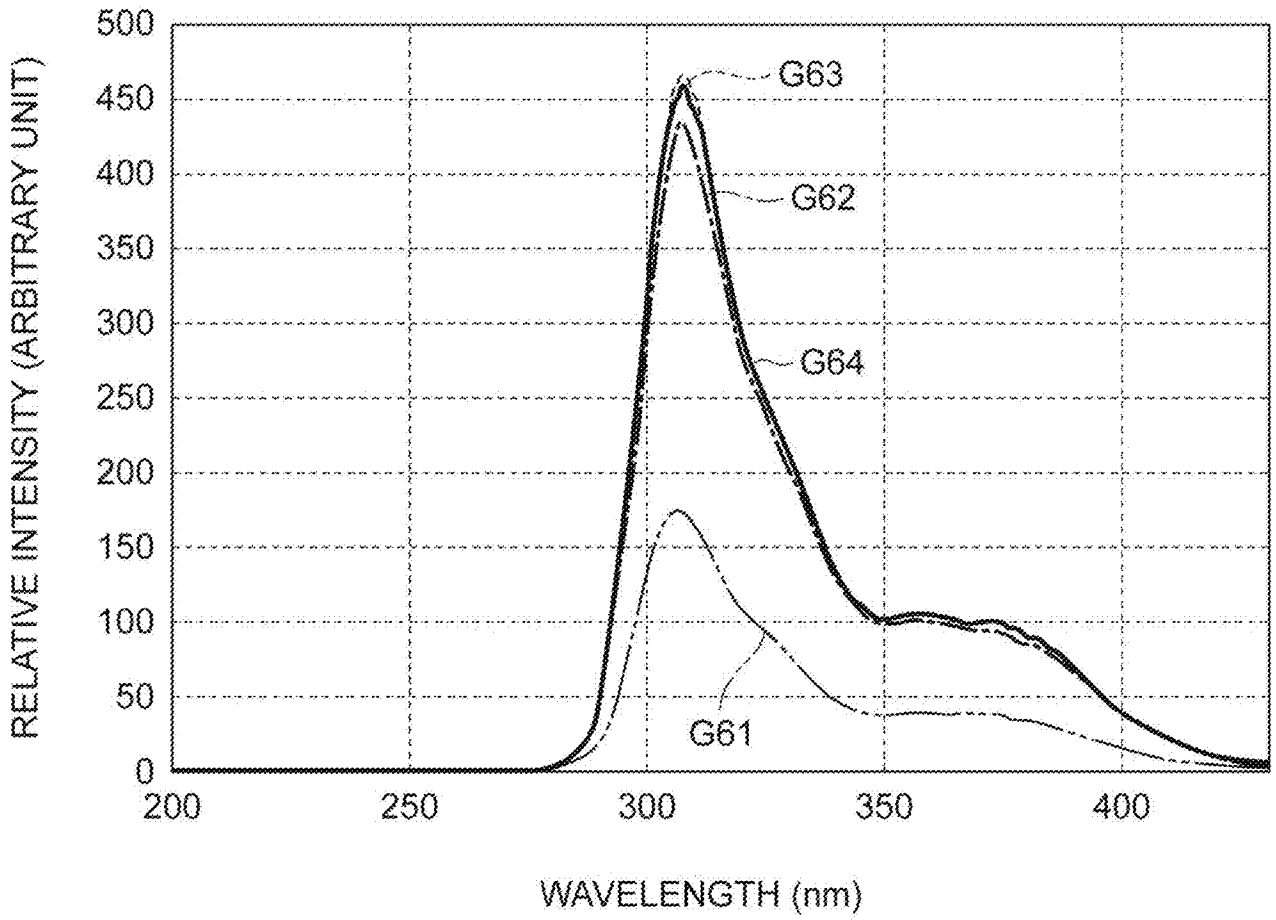
FIG. 16 is a graph illustrating luminous intensities (relative values) at individual wavelengths in a second example.

FIG. 16 is a graph illustrating luminous intensities (relative values) at individual wavelengths. In FIG. 16, a graph G61 illustrates a case in which the interlayer 28 was not provided, and graphs G62, G63, and G64 illustrate cases in which the number of the layers 28*a* laminated together was two, three, and four respectively. As illustrated in FIG. 16, in the cases in which the interlayer 28 was provided, higher peak intensities were obtained than the case in which the interlayer 28 was not provided, and furthermore, there was a tendency that the peak intensity increases as the number of the layers 28*a* laminated together increases. For example, in the case in which the number of the layers 28*a* laminated together was three (the graph G63), it was possible to realize a peak intensity that was approximately 2.6 times the peak intensity in the case in which the interlayer 28 was not provided (the graph G61).

Figure 17:
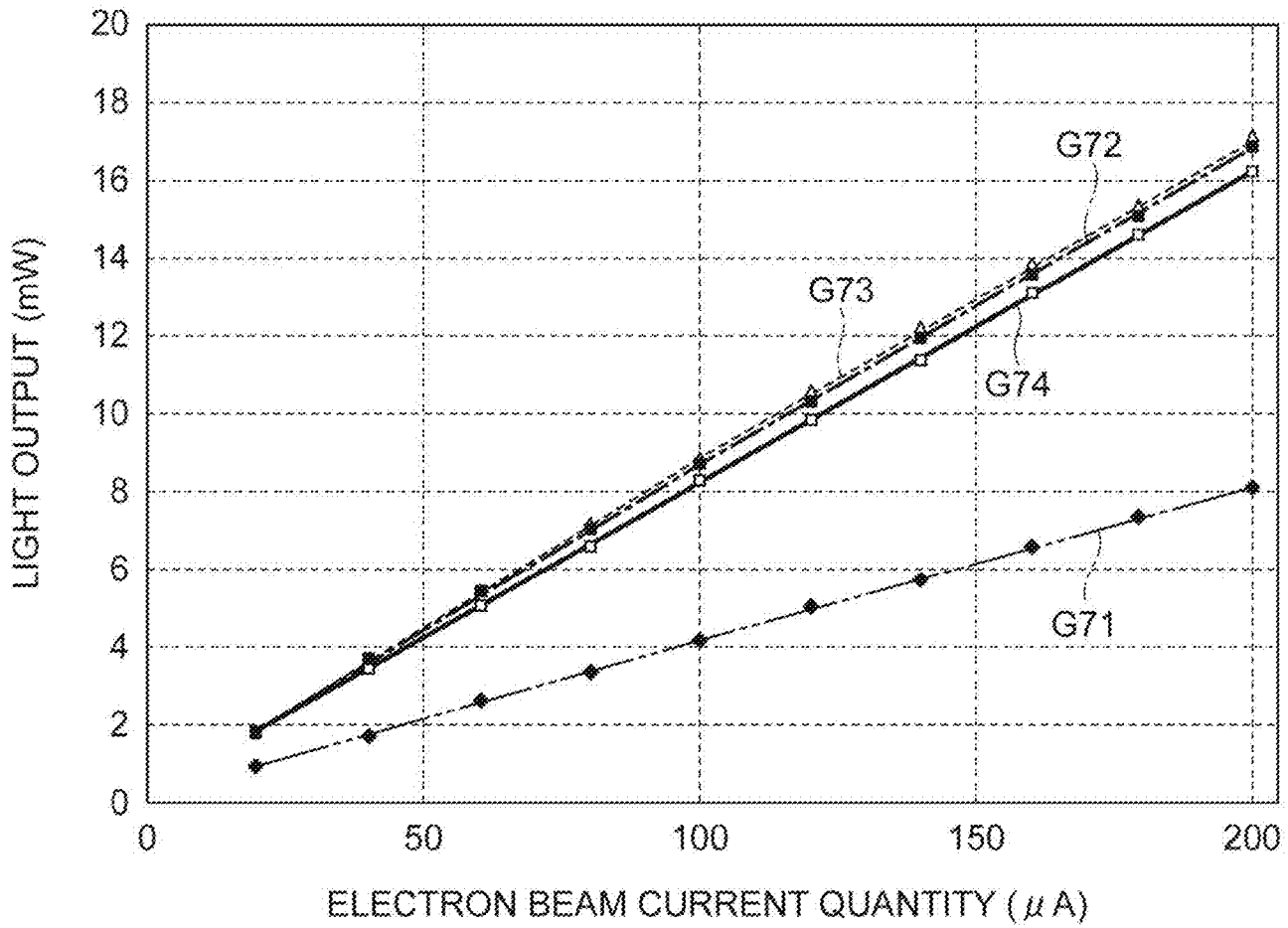
FIG. 17 is a graph illustrating a relationship between an electron beam current quantity and a light output in the second example.

FIG. 17 is a graph illustrating a relationship between the electron beam current quantity and the light output. In FIG. 17, a graph G71 illustrates a case in which the interlayer 28 was not provided, and graphs G72, G73, and G74 illustrate cases in which the number of the layers 28*a* laminated together was two, three, and four respectively. As illustrated in FIG. 17, in the cases in which the interlayer 28 was provided, higher light output efficiencies were obtained than the case in which the interlayer 28 was not provided. For example, in the case in which the number of the layers 28*a* laminated together was three (the graph G73), it was possible to realize a light output efficiency that was approximately 2.1 times the light output efficiency in the case in which the interlayer 28 was not provided (the graph G71).

Figure 18:
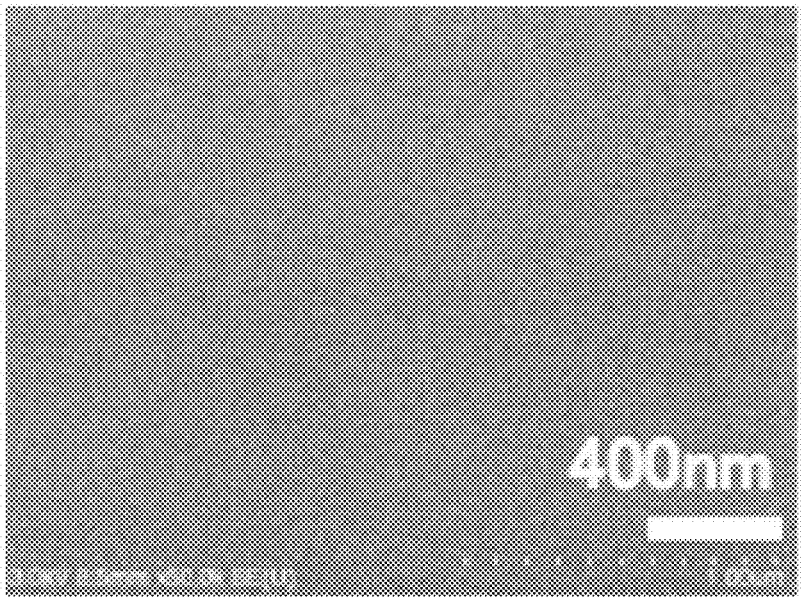
FIGS. 18(*a*) and 18(*b*) are enlarged SEM images illustrating surfaces of a luminous layer in a target for ultraviolet light generation not provided with an interlayer.
Figure 18:
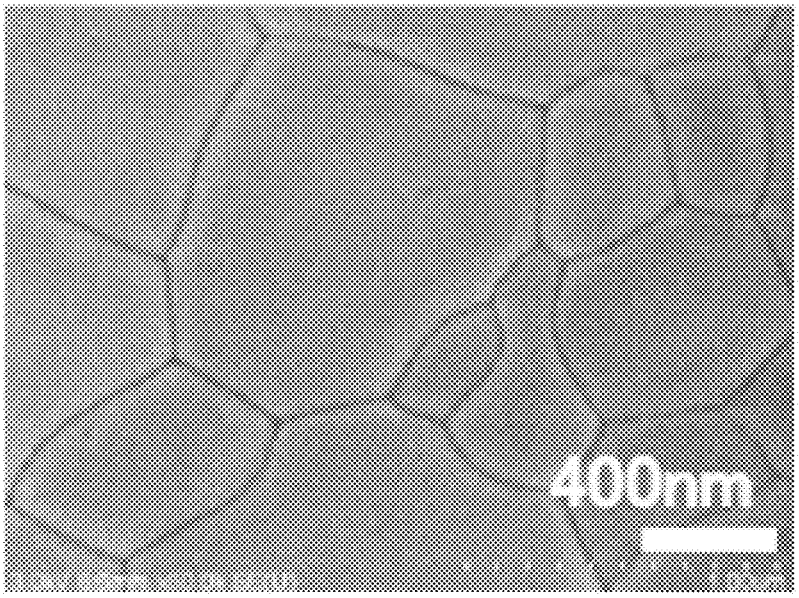
Figure 19:
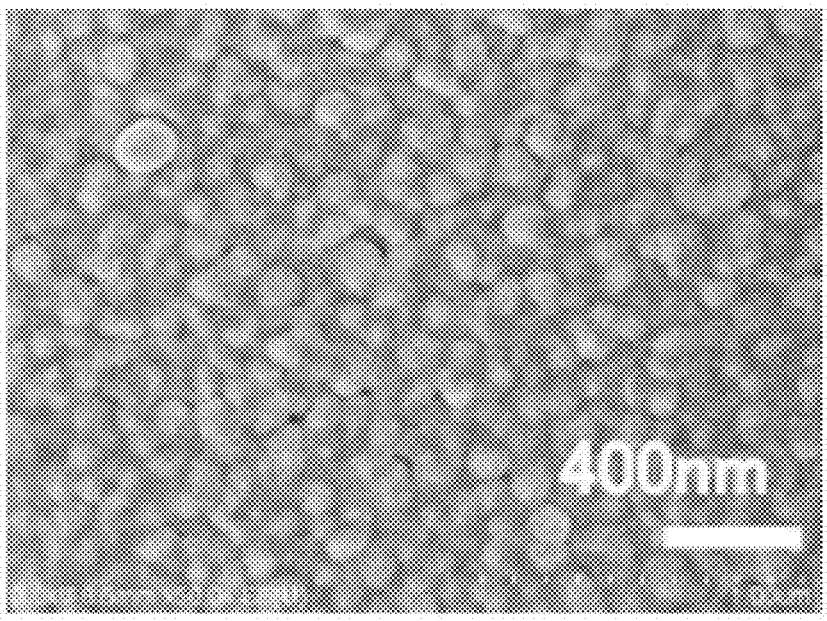
FIGS. 19(*a*) and 19(*b*) are enlarged SEM images illustrating surfaces of the luminous layer in the target for ultraviolet light generation provided with the interlayer.
Figure 19:
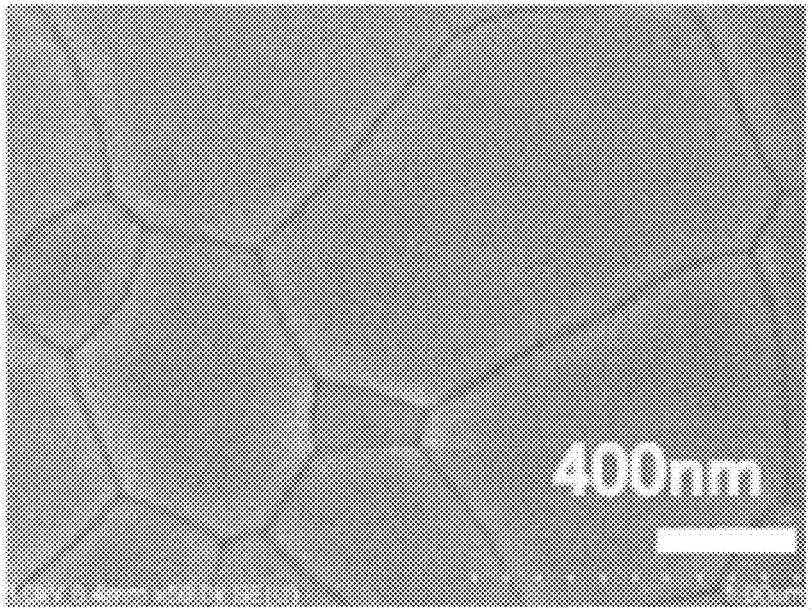

FIG. 18 illustrates enlarged SEM images of the surface of the luminous layer 23 in the target for ultraviolet light generation not provided with the interlayer 28. FIG. 18(*a*) illustrates a state before a thermal treatment, and FIG. 18(*b*) illustrates a state after the thermal treatment. In addition, FIG. 19 illustrates enlarged SEM images of the surface of luminous layer 23 in a target for ultraviolet light generation 1B provided with the interlayer 28. FIG. 19(*a*) illustrates a state before a thermal treatment, and FIG. 19(*b*) illustrates a state after the thermal treatment. It is found that, as illustrated in FIG. 18 and FIG. 19, even in a case in which the interlayer 28 was provided, similar to the case in which the interlayer 28 was not provided, the luminous layer 23 preferably crystallized by the thermal treatment.

Figure 20:
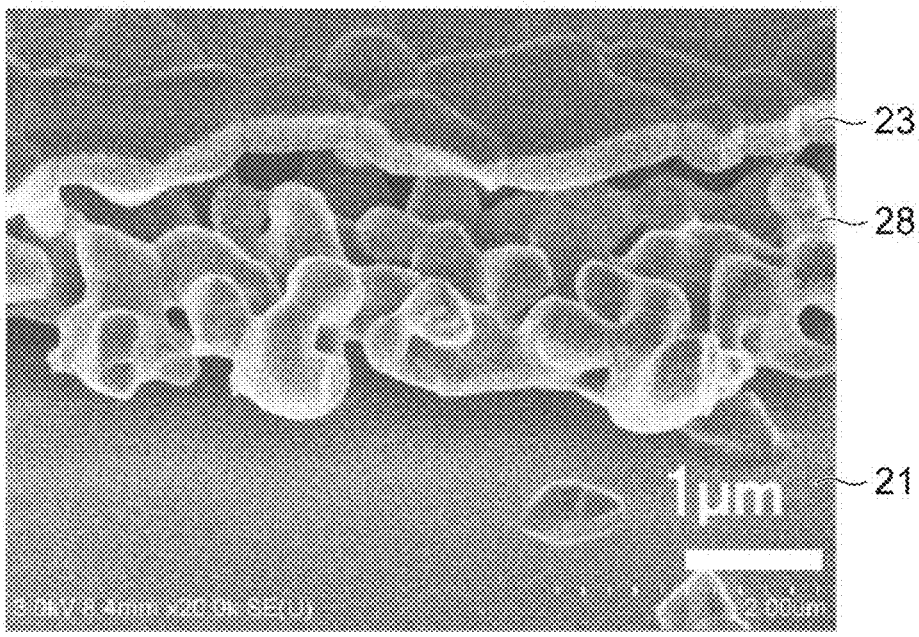
FIG. 20 is an enlarged SEM image of the interlayer after a thermal treatment in a case in which the number of layers laminated together in the interlayer is two.
Figure 21:
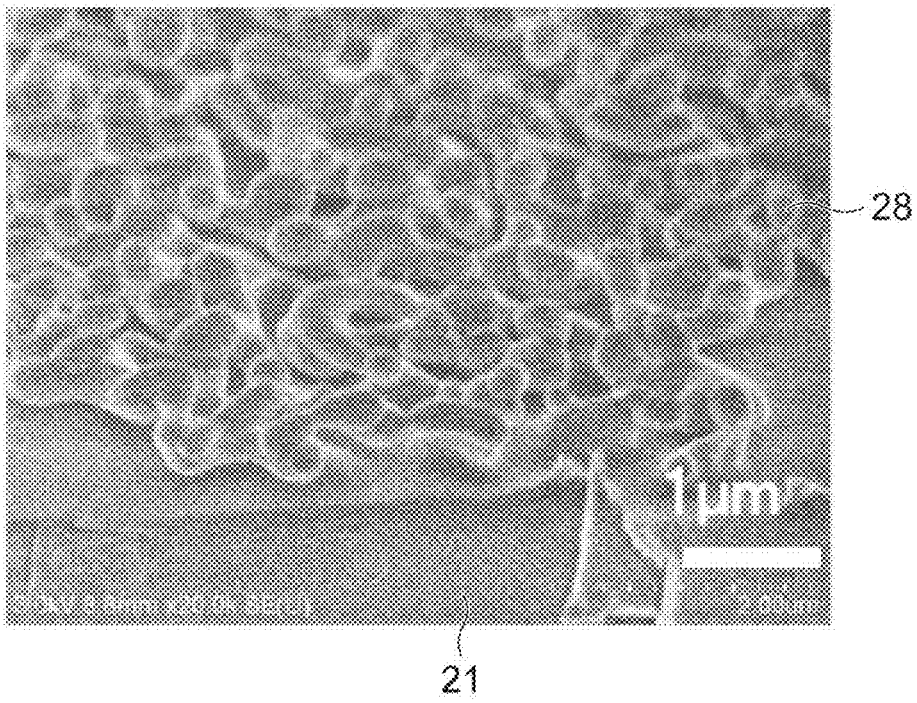
FIG. 21 is an enlarged SEM image of the interlayer after the thermal treatment in a case in which the number of layers laminated together in the interlayer is two.

In addition, FIG. 20 and FIG. 21 illustrate enlarged SEM image of the interlayer 28 after the thermal treatment in a case in which the number of the layers 28*a* laminated together in the interlayer 28 is two. Meanwhile, FIG. 20 illustrates a case in which the interlayer 28 and the luminous layer 23 were thermally treated at the same time, and FIG. 21 illustrates a case in which only the interlayer 28 was thermally treated. With reference to FIG. 20 and FIG. 21, it is found that the interlayer 28 including fine structures is preferably formed.

Figure 22:
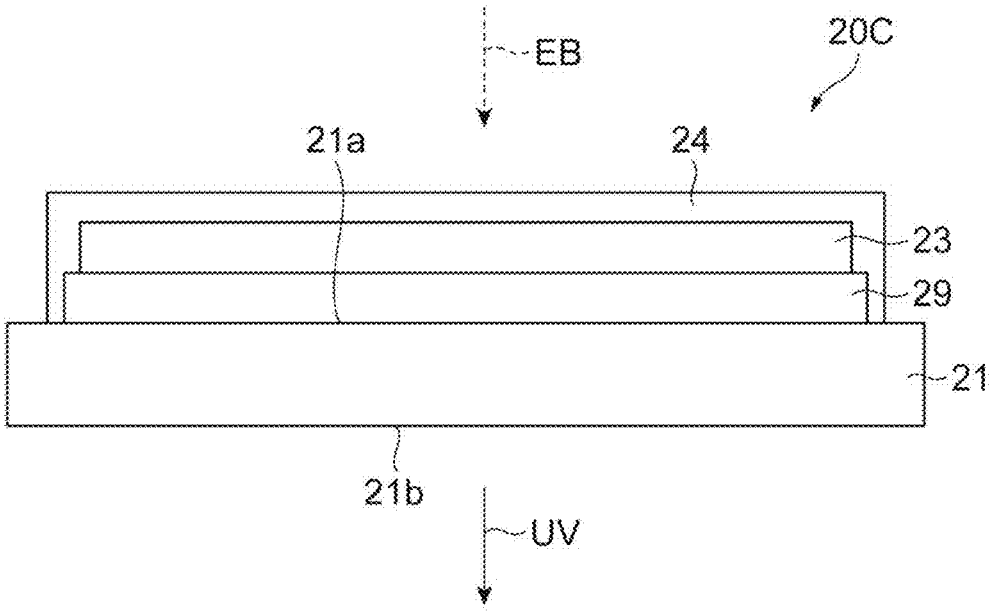
FIG. 22 is a side view illustrating a constitution of a target for ultraviolet light generation according to a second embodiment.

(Second Embodiment) Subsequently, a target for ultraviolet light generation according to a second embodiment of the present invention will be described. FIG. 22 is a side view illustrating the constitution of a target for ultraviolet light generation 20C of the present embodiment. As illustrated in FIG. 22, the target for ultraviolet light generation 20C includes the substrate 21, an interlayer 29 provided on the substrate 21, the luminous layer 23 provided on the interlayer 29, and the light reflection film 24 provided on the luminous layer 23. Among these, other constitutions except for the interlayer 29 are the same as those in the first embodiment.

The interlayer 29 is in contact with the main surface 21*a* of the substrate 21 and transmits the ultraviolet light UV. The interlayer 29 is an aggregate of fine structures made of a material including oxygen atoms and aluminum atoms in the composition and, in the present embodiment, the fine structures are powder-form or granular aluminum oxide disposed on the main surface 21*a*. As an example, the interlayer 29 is formed by thermally treating powder-form or granular aluminum oxide (alumina powder) applied onto the main surface 21*a*.

Figure 23:
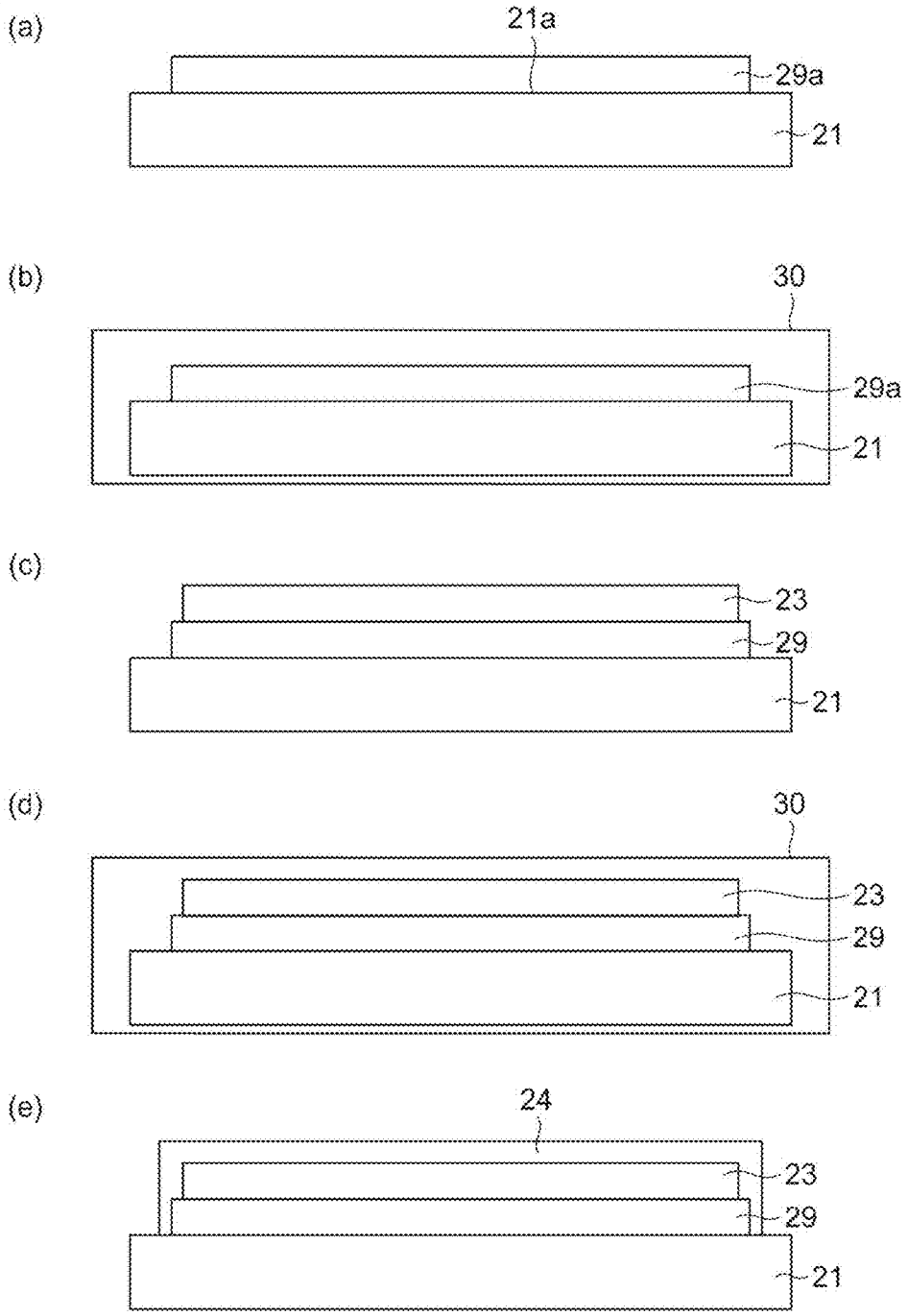
FIGS. 23(*a*), 23(*b*), 23(*c*), 23(*d*), and 23(*e*) are views illustrating individual steps in a method for manufacturing the target for ultraviolet light generation according to the second embodiment.
Figure 24:
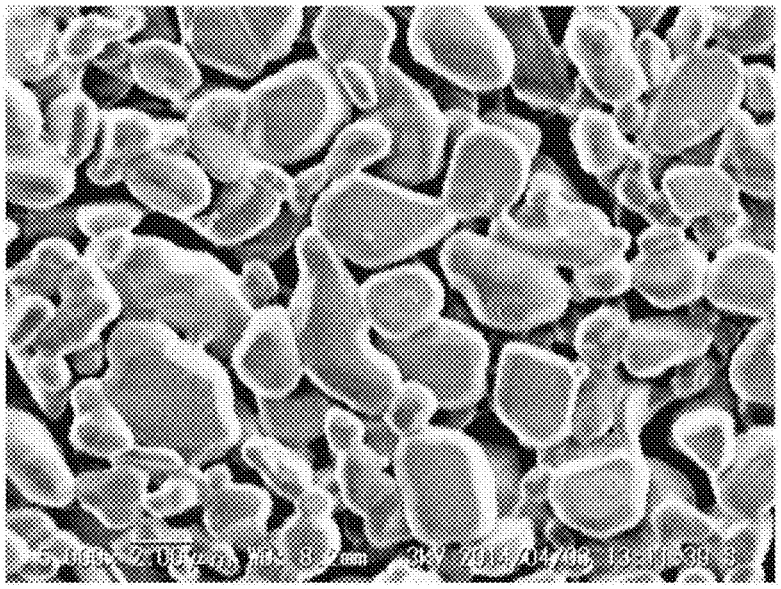
FIGS. 24(*a*) and 24(*b*) are enlarged SEM images of an interlayer in a target for ultraviolet light generation according to a third example.
Figure 24:
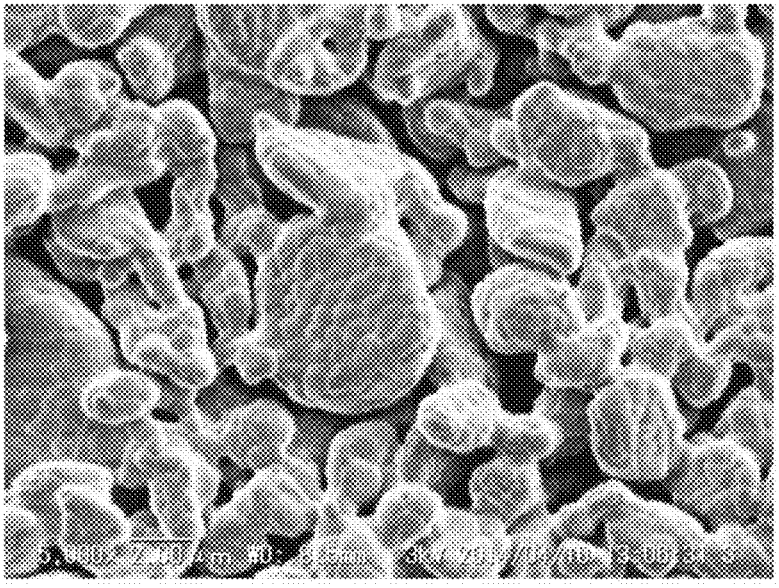
Figure 25:
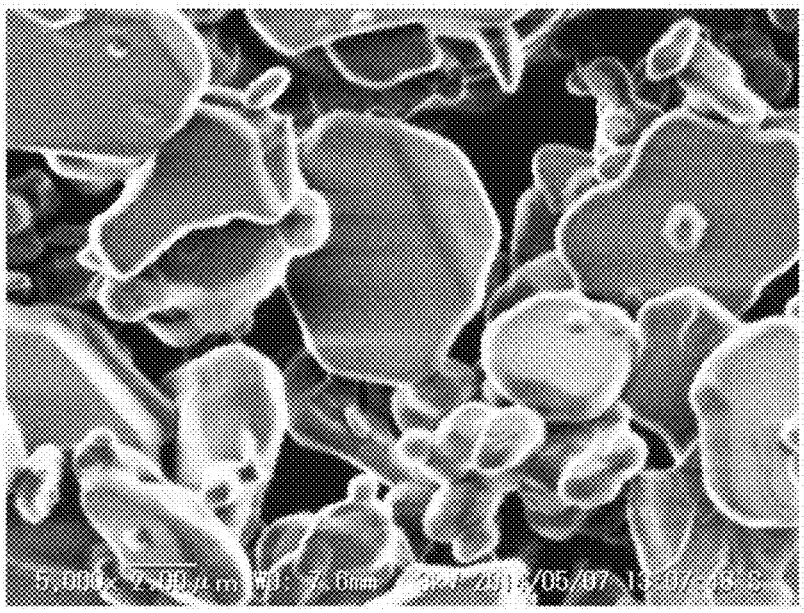
FIGS. 25(*a*) and 25(*b*) are enlarged SEM images of the interlayer in the target for ultraviolet light generation according to the third example.
Figure 25:
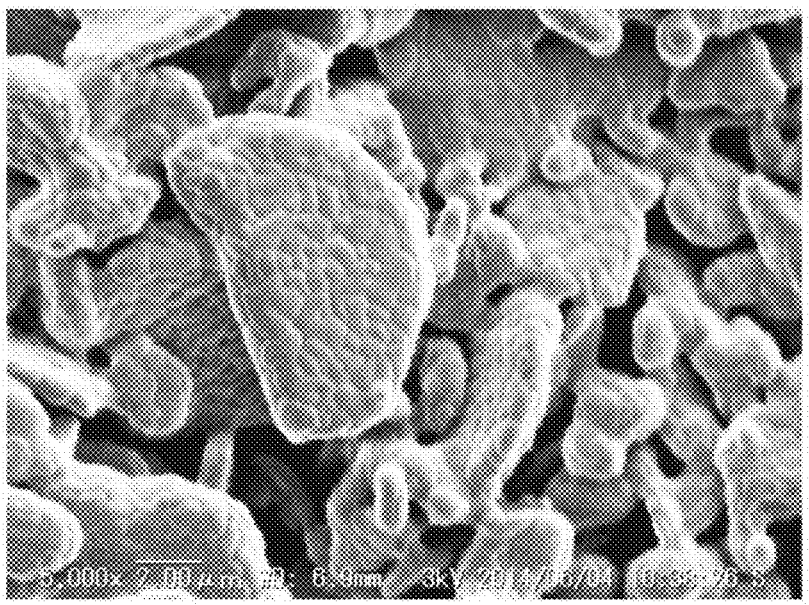
Figure 26:
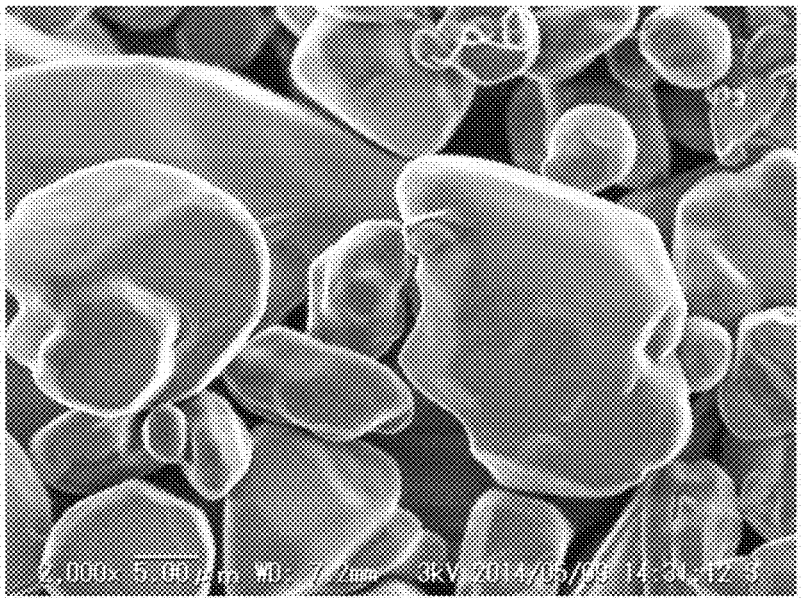
FIGS. 26(*a*) and 26(*b*) are enlarged SEM images of the interlayer in the target for ultraviolet light generation according to the third example.
Figure 26:
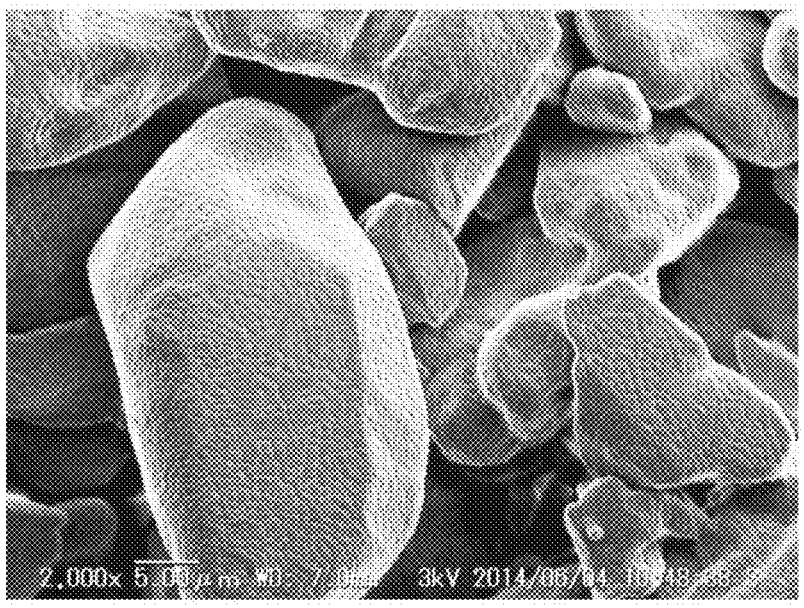

FIG. 23 illustrates views of individual steps in a method for manufacturing the target for ultraviolet light generation 20C. First, as illustrated in FIG. 23(*a*), powder-form or granular aluminum oxide 29*a* is applied onto the main surface 21*a* of the substrate 21 (a first step). The coating thickness at this time may be a thickness at which aluminum oxide particles having individual particle sizes can be uniformly dispersed on the main surface 21*a*.

Next, the powder-form or granular aluminum oxide 29*a* is thermally treated (a second step). In this step, as illustrated in FIG. 23(*b*), the substrate 21 onto which the powder-form or granular aluminum oxide 29*a* is applied is installed in the thermal treatment furnace 30. The thermal treatment furnace 30 is, for example, a vacuum furnace. In addition, the powder-form or granular aluminum oxide 29*a* is thermally treated in a vacuum and fired. The thermal treatment temperature is, for example, 1,000° C. or higher and 2,000° C. or lower and, as an example, 1,600° C. In addition, the thermal treatment duration is, for example, zero hours (that is, the temperature is lowered immediately after reaching a predetermined temperature) or longer and 100 hours or shorter and, as an example, two hours. In such a case, the surfaces of individual particles of the powder-form or granular aluminum oxide 29*a* are melted, and the respective particles are bonded to one another and fixed to the substrate 21, whereby the interlayer 29 illustrated in FIG. 22 is formed.

Subsequently, the material of the luminous layer 23 is disposed on the interlayer 29. In this step, the substrate 21 on which the interlayer 29 is formed is installed in an ablation apparatus, and, as illustrated in FIG. 23(*c*), the luminous material layer 27 is formed on the interlayer 29 by means of laser ablation. In addition, as illustrated in FIG. 23(*d*), the substrate 21 on which the luminous material layer 27 is formed is installed in the thermal treatment furnace 30, and the luminous material layer 27 is thermally treated in a vacuum and fired. The thermal treatment temperature and the thermal temperature duration are the same as those in the first embodiment described above. Therefore, the constituent material of the luminous material layer 27 crystallizes, and the luminous layer 23 is formed.

Finally, the substrate 21 on which the luminous layer 23 and the interlayer 29 are formed is removed from the thermal treatment furnace 30, and the light reflection film 24 is formed (FIG. 23(*e*)). In this step, for example, a nitrocellulose film is formed on the luminous layer 23, and an aluminum film is deposited on the nitrocellulose film. The thickness of the aluminum film is, for example, 20 nm. In addition, the substrate 21 is installed in the thermal treatment furnace, and the nitrocellulose film is fired in the atmosphere so as to be gasified. The thermal treatment temperature at this time is, for example, 350° C., and the thermal treatment duration is, for example, 10 minutes. After that, an aluminum film is further deposited on the aluminum film. The thickness of this aluminum film is, for example, 30 nm. In the above-described manner, the light reflection film 24 made of two layers of the aluminum film is formed. Through the above-described steps, the target for ultraviolet light generation 20C of the present embodiment is completed.

According to the target for ultraviolet light generation 20C of the present embodiment, similar to the first embodiment, the interlayer 29 includes oxygen atoms and aluminum atoms in the composition, and it is possible to impart fine structures for reducing the reflection of ultraviolet light UV to the interlayer 29. Therefore, it becomes possible to increase the extraction efficiency of ultraviolet light UV. In addition, when the fine structures in the interlayer 29 are powder-form or granular aluminum oxide as in the present embodiment, it is possible to easily form an aggregate of the fine structures, and thus it is possible to effectively reduce the reflection of ultraviolet light UV in the interlayer 29.

THIRD EXAMPLE

Subsequently, a target for ultraviolet light generation 20C of the second embodiment is produced, and the investigation results of the light output characteristics thereof will be described. In the present example, a target for ultraviolet light generation not provided with the interlayer 29 and four targets for ultraviolet light generation 20C provided with the interlayer 29 were produced. The average particle diameters of the aluminum oxide 29*a* used to form the interlayers 29 in the four targets for ultraviolet light generation 20C were 3.1 μm, 5.2 μm, 21.7 μm, and 24 μm respectively. In the target for ultraviolet light generation not provided with the interlayer 29, Pr:LuAG crystals were formed on a sapphire substrate for one hour by means of laser ablation and thermally treated at 1,500° C. for two hours in a vacuum, and a 50 nm-thick light reflection film was deposited thereon. In addition, in the four targets for ultraviolet light generation 20C, the thermal treatment temperature of the aluminum oxide 29*a* was set to 1,600° C., and the thermal treatment duration was set to two hours. Furthermore, as the luminous layer 23, Pr:LuAG crystals were formed for one hour by means of laser ablation and thermally treated at 1,500° C. for two hours in a vacuum, and the 50 nm-thick light reflection film 24 was deposited thereon. Meanwhile, the acceleration voltage of an electron beam-excited ultraviolet light source to which the targets for ultraviolet light generation were attached was set to 10 kV, the tube current was set to 800 μA, and the electron beam diameter was set to 2 mm.

Figure 27:
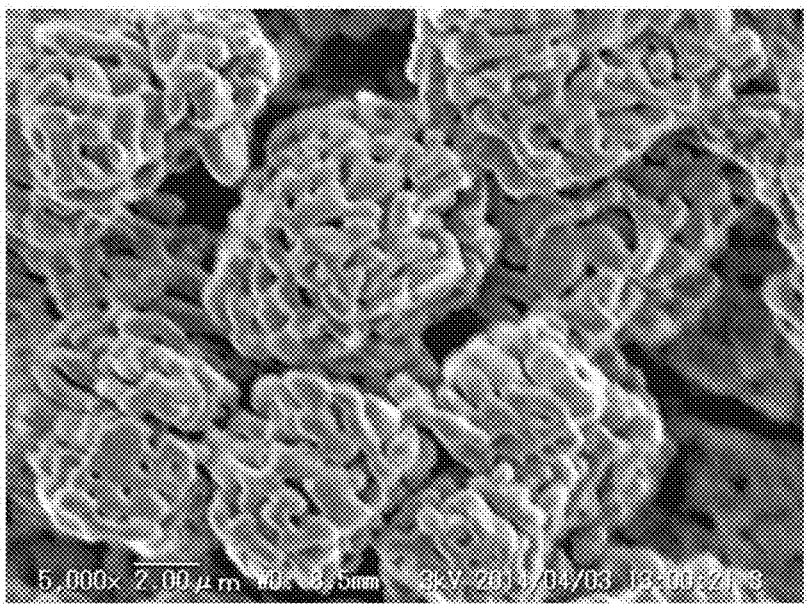
FIGS. 27(*a*) and 27(*b*) are enlarged SEM images of the interlayer in the target for ultraviolet light generation according to the third example.
Figure 27:
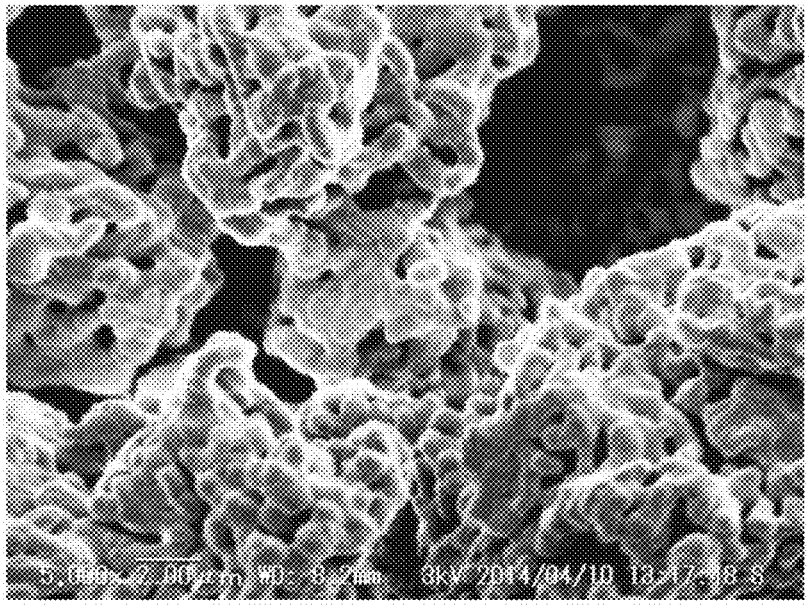

FIGS. 24 to 27 are enlarged SEM images of the interlayers 29 in the four targets for ultraviolet light generation. 20C and respectively illustrate a case in which the average particle diameter of the aluminum oxide 29*a* was 3.1 μm (FIG. 24), a case in which the average particle diameter of the aluminum oxide was 5.2 μm (FIG. 25), a case in which the average particle diameter of the aluminum oxide was 21.7 μm (FIG. 26), and a case in which the average particle diameter of the aluminum oxide was 24 μm (FIG. 27). In these views, (a)'s illustrates a state after a first thermal treatment (1,600° C., two hours), and (b)'s illustrates a state after a second thermal treatment (1,500° C., two hours). With reference to (a)'s in FIGS. 24 to 27, it is found that fine structures made of aluminum oxide aggregated together, bonded to one another, and were integrated. In addition, with reference to (b)'s in FIGS. 24 to 27, it is found that regions made of the Pr:LuAG crystals were formed on the surface of the aluminum oxide.

Figure 28:
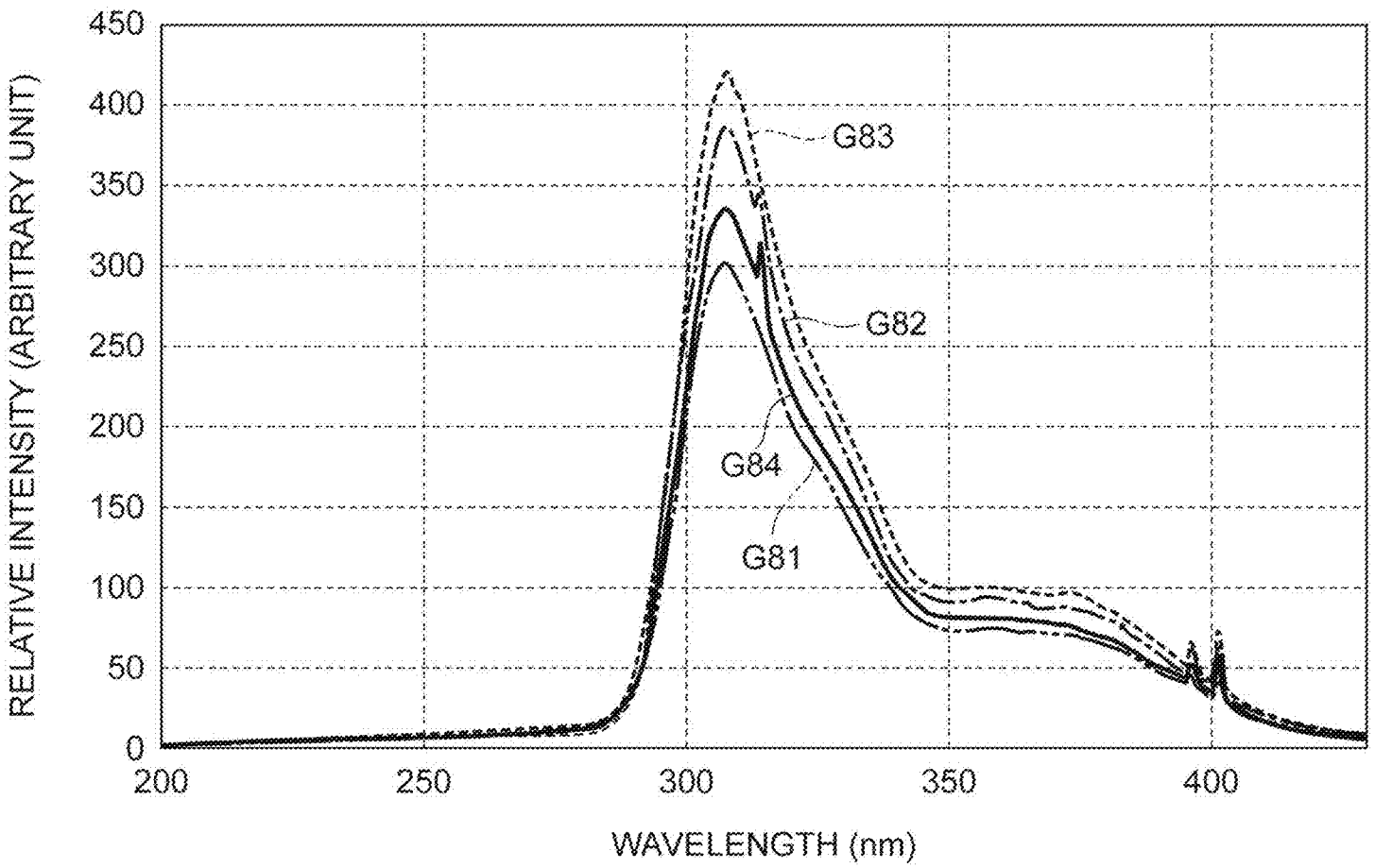
FIG. 28 is a graph illustrating luminous intensities (relative values) at individual wavelengths in the third example.

FIG. 28 is a graph illustrating luminous intensities (relative values) at individual wavelengths. FIG. 28 illustrates individual graphs of cases in which the average particle diameter of the aluminum oxide was 3.1 μm (a graph G81), 5.2 μm (a graph G82), 21.7 μm (a graph G83), and 24 μm (a graph G84). Meanwhile, these graphs were measured at a tube current set to 200 μA. As illustrated in FIG. 28, the luminous peak intensity was highest in the case of the average particle diameter of 21.7 μm, and the peak intensity was lowest in the case of the average particle diameter of 3.1 μm.

Figure 29:
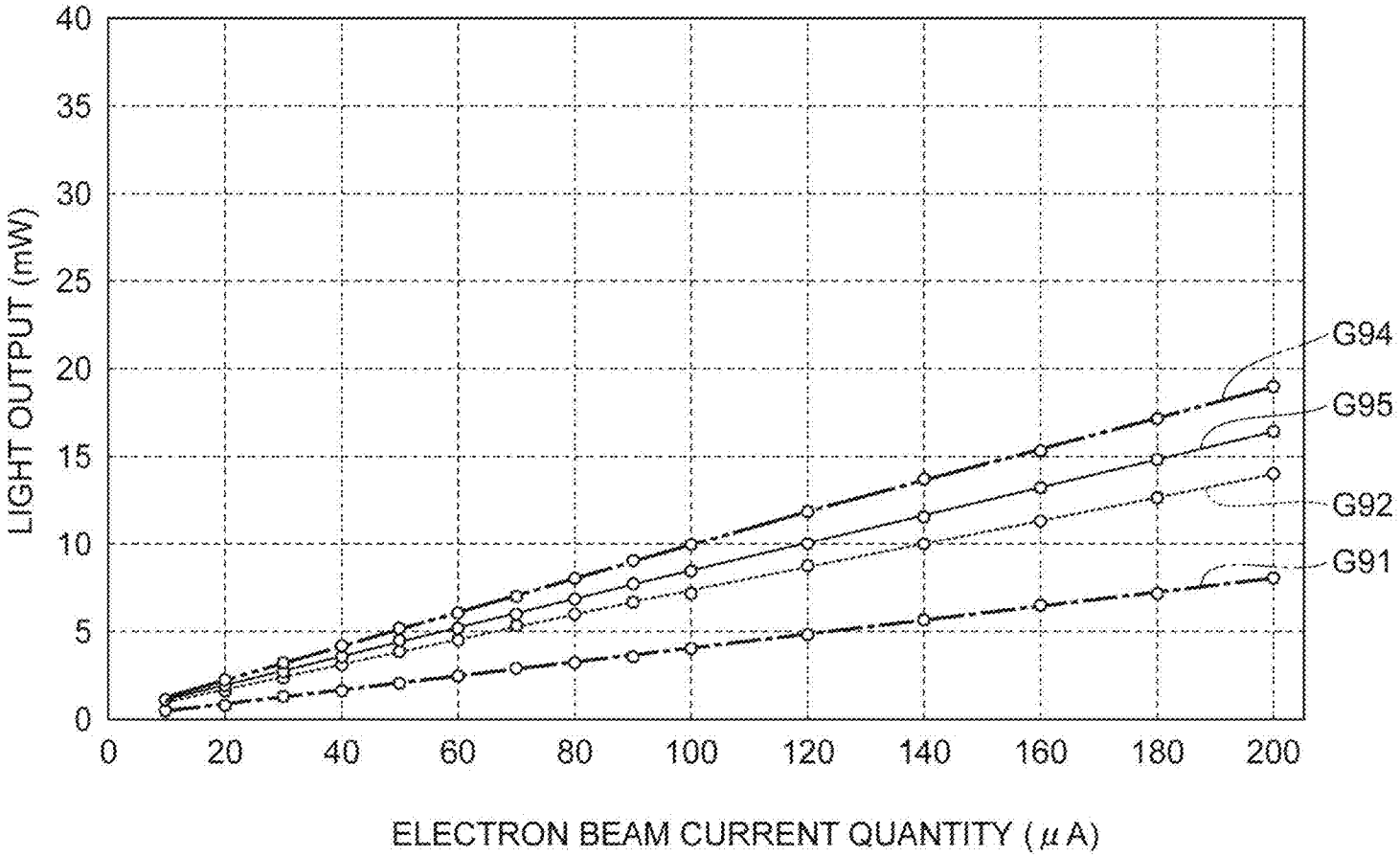
FIG. 29 is a graph illustrating a relationship between an electron beam current quantity and a light output in the third example.

FIG. 29 is a graph illustrating a relationship between the electron beam current quantity and the light output in the third example.

In FIG. 29, a graph G91 illustrates a case in which the interlayer 29 was not provided, and graphs G92, G94, and G95 illustrate cases in which the average particle diameters of the aluminum oxide were 3.1 μm, 21.7 μm, and 24 μm respectively. As illustrated in FIG. 29, in the cases in which the interlayer 29 was provided, higher light output efficiencies were obtained than the case in which the interlayer 29 was not provided, and furthermore, there was a tendency that the light output efficiency increases as the average particle diameter of the aluminum oxide in the interlayer 29 increases. Meanwhile, in a case in which the average particle diameter was 24 μm, the light output became lower compared to a case in which the average particle diameter was 21.7 μm; however, as is clear from the SEM image of FIG. 27, the aluminum oxide particles had shapes that were slightly different from those of particles having different particle diameters, and fine particles aggregated so as to constitute an average particle diameter of 24 μm. Therefore, the light output is considered to become low.

Figure 30:
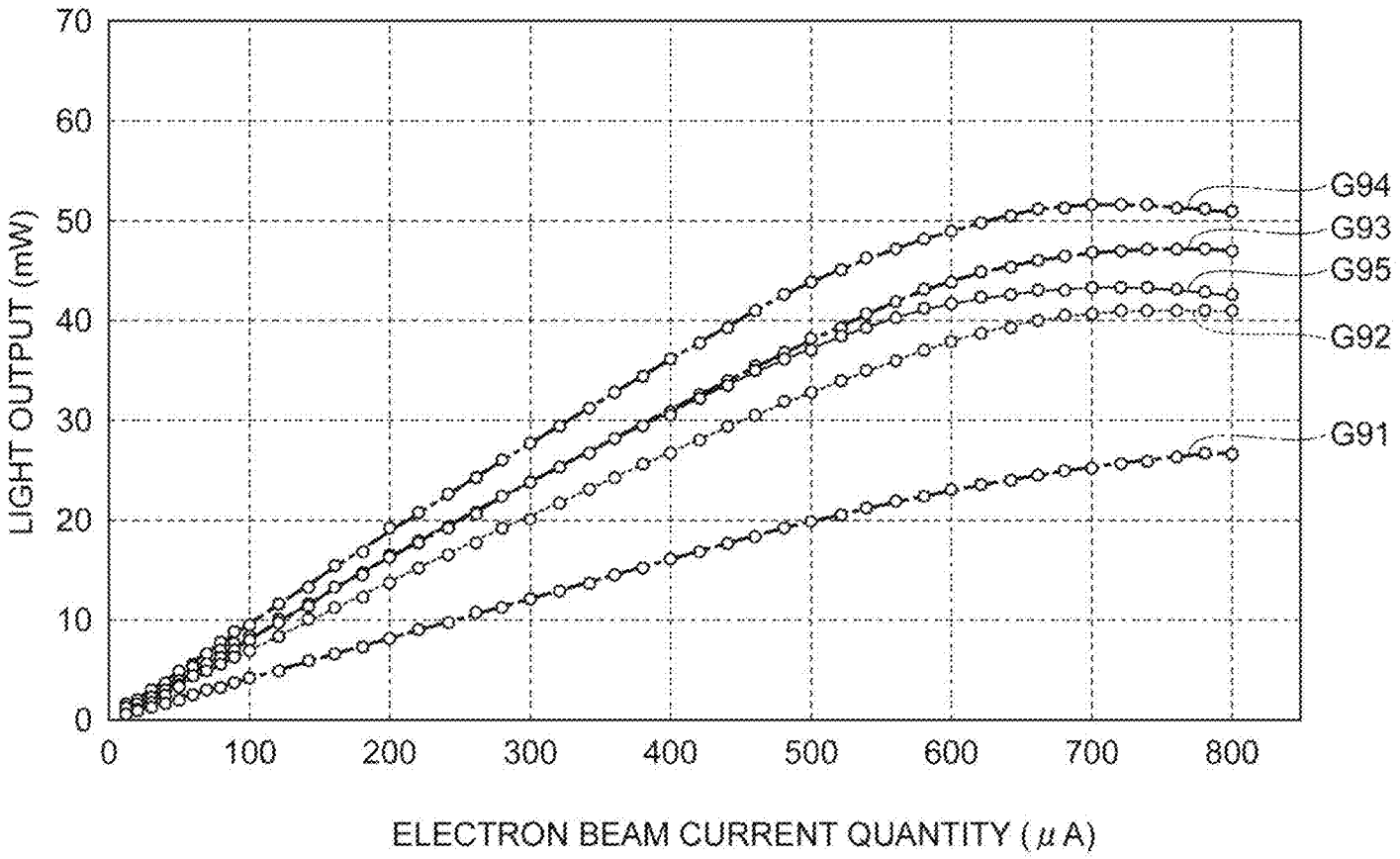
FIG. 30 is a graph illustrating the relationship between the electron beam current quantity and the light output in the third example in a case in which the electron beam current quantity is further increased.

FIG. 30 is a graph illustrating the relationship between the electron beam current quantity and the light output in a case in which the electron beam current quantity is further increased (~800 μA). In FIG. 30, the graph G91 illustrates a case in which the interlayer 29 was not provided, and the graphs G92, G93, G94, and G95 illustrate cases in which the average particle diameters of the aluminum oxide were 3.1 μm, 5.2 μm, 21.7 μm, and 24 μm respectively. Regardless of the particle diameters, the saturation of the light output was observed in a case in which the tube current was 700 μA or more, but the degree of the saturation decreased as the average particle diameter decreased.

Figure 31:
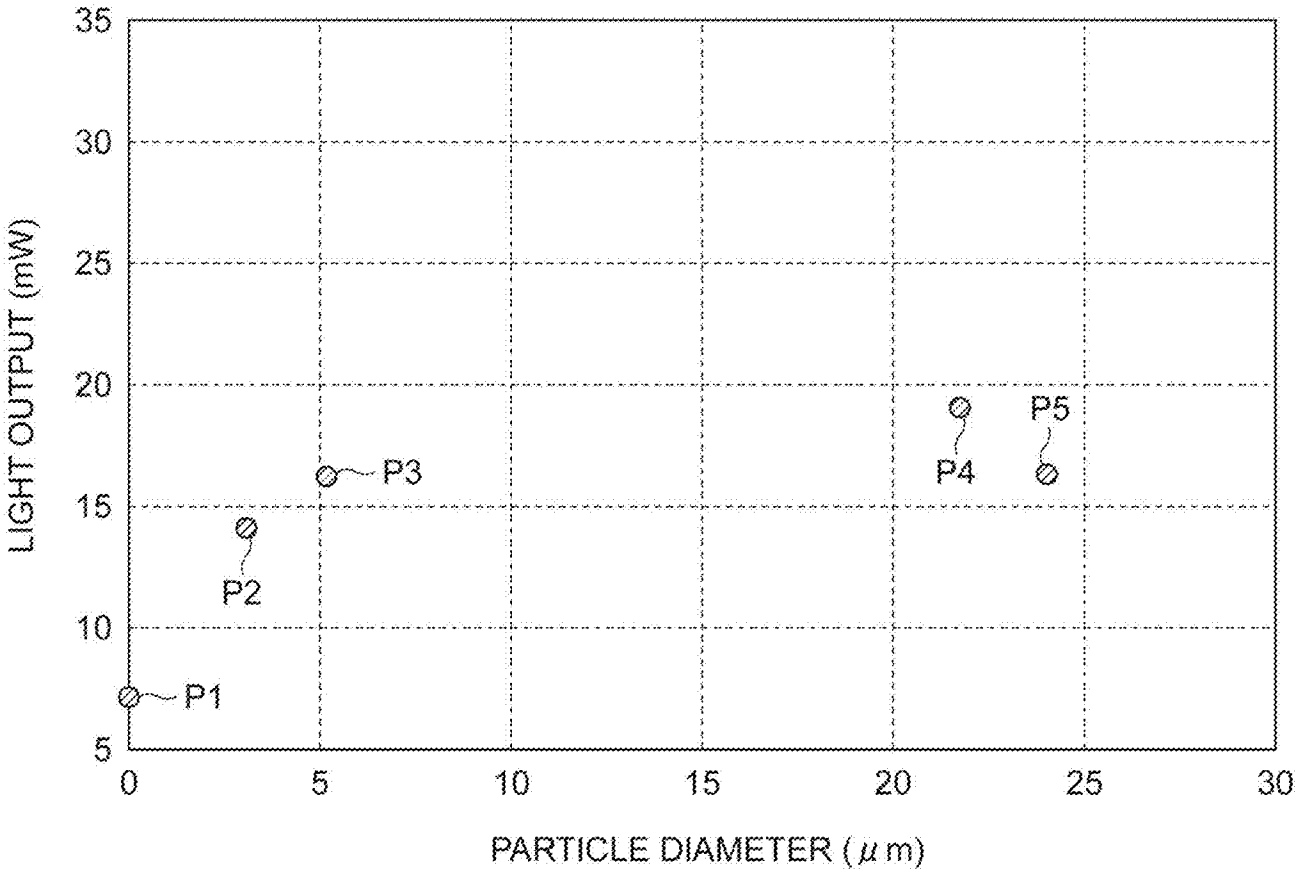
FIG. 31 is a graph illustrating a relationship between an average particle diameter of aluminum oxide and a light output in the third example.

FIG. 31 is a graph illustrating a relationship between the average particle diameter of aluminum oxide and the light output in a case in which the electron beam current quantity was set to 200 μA. In FIG. 31, a plot P1 indicates a case in which the interlayer 29 was not provided, and plots P2 to P5 indicate the cases in which the average particle diameters of the aluminum oxide were 3.1 μm, 5.2 μm, 21.7 μm, and 24 μm respectively. As illustrated in FIG. 31, regardless of the average particle diameters, extremely larger light outputs could be obtained compared to the case in which the interlayer 29 was not provided.

The target for ultraviolet light generation and the method for manufacturing the same according to the present invention are not limited by the above-described embodiments and can be modified in a variety of manners.

INDUSTRIAL APPLICABILITY

According to the target for ultraviolet light generation and the method for manufacturing the same as aspects of the present invention, it is possible to increase the extraction efficiency of ultraviolet light.

REFERENCE SIGNS LIST

10 electron beam-excited ultraviolet light source
11 container
12 electron source
13 electrode
16 power supply portion
20A, 20B, 20C target for ultraviolet light generation
21 substrate
21*a* main surface
22, 28, 29 interlayer
23 luminous layer
24 light reflection film
25 aluminum film
26 aluminum hydroxide film
27 luminous material layer
29*a* powder-form or granular aluminum oxide
30 thermal treatment furnace
EB electron beam
UV ultraviolet light

The invention claimed is:

1. A target for ultraviolet light generation comprising:
a sapphire substrate that transmits ultraviolet light,
an interlayer that is in contact with the sapphire substrate, includes oxygen atoms and aluminum atoms in a composition, and transmits ultraviolet light; and
a luminous layer that is provided on the interlayer, includes oxide crystals containing rare earth elements to which an activator agent is added, and receives electron beams so as to generate ultraviolet light,
wherein the interlayer is formed by fine structures made of aluminum oxide aggregated together, bonded to one another, and integrated.

2. The target for a ultraviolet light generation according to claim 1,
wherein the interlayer is formed by thermally treating an aluminum hydroxide film formed on the sapphire substrate.

3. The target for ultraviolet light generation according to claim 1,
wherein the tine structure is a powder-form or granular aluminum oxide.

4. The target for ultraviolet generation according to claim 1,
wherein the oxide crystals are polycrystals.

5. A method for manufacturing the target for ultraviolet light generation according to claim 1, the method comprising:
a first step of forming an aluminum hydroxide film on the sapphire substrate; and
a second step of forming the interlayer by thermally treating the aluminum hydroxide film.

6. The method for manufacturing the target for ultraviolet light generation according to claim 5, the method further comprising:
a third step of disposing a material of the luminous layer on the interlayer after the second step; and
a fourth step of forming the luminous layer by thermally treating the material of the luminous layer.

7. The method for manufacturing the target for ultraviolet light generation according to claim 5, the method further comprising:
a step of disposing a material of the luminous layer on the aluminum hydroxide film after the first step and before the second step,
wherein, in the second step, the material of the luminous layer is thermally treated together with the aluminum hydroxide film, thereby forming the interlayer and the luminous layer.

8. A method for manufacturing the target for ultraviolet light generation according to claim 1, the method comprising:
a first step of applying powder-form or granular aluminum oxide onto the sapphire substrate; and
a second step of forming the interlayer by thermally treating the powder-form or granular aluminum oxide.

* * * * *